US012757958B1

(12) United States Patent
Matlin

(10) Patent No.: US 12,757,958 B1
(45) Date of Patent: Oct. 13, 2026

(54) CUSTOMIZABLE SLIDING INSERT FOR HAT

(71) Applicant: Joel Matlin, Toronto (CA)

(72) Inventor: Joel Matlin, Toronto (CA)

( * ) Notice: Subject to any disclaimer, the term of this patent is extended or adjusted under 35 U.S.C. 154(b) by 0 days.

(21) Appl. No.: 19/304,116

(22) Filed: Aug. 19, 2025

Related U.S. Application Data

(60) Provisional application No. 63/831,470, filed on Jun. 27, 2025.

(51) Int. Cl.
*A42B 1/004* (2021.01)
*A42B 1/248* (2021.01)

(52) U.S. Cl.
CPC ..... *A42B 1/004* (2013.01); *A42B 1/248* (2013.01)

(58) Field of Classification Search
CPC ..... A42B 1/004; A42B 1/248
USPC ..... 2/209.13
See application file for complete search history.

(56) References Cited

U.S. PATENT DOCUMENTS 2,193,536 A * 3/1940 Murdoch, Jr. ..... H04M 1/04 379/455
5,315,714 A * 5/1994 Peters ..... G09F 3/04 2/209.13
5,687,425 A * 11/1997 Blosser ..... A42B 1/22 2/209.13
D396,547 S * 8/1998 Capparella ..... D2/866
6,006,362 A * 12/1999 Walsh ..... A42B 1/248 2/181.2
6,282,725 B1 * 9/2001 Vanidestine, Jr. ..... A42B 3/08 2/209.13
D684,683 S * 6/2013 Curti ..... D24/110
D923,921 S * 7/2021 Tsakiris ..... D2/639
D927,144 S * 8/2021 Tsakiris ..... D2/639
11,224,260 B2 * 1/2022 Inouye ..... A42C 5/02
11,344,074 B2 * 5/2022 Cho ..... A42B 1/22
11,930,874 B1 * 3/2024 Aydelott ..... A42B 1/241
2002/0152539 A1 * 10/2002 Christian ..... A42B 1/24 2/209.13
2019/0335837 A1 * 11/2019 Kang ..... A42B 1/22

* cited by examiner

*Primary Examiner* — Gloria M Hale
(74) *Attorney, Agent, or Firm* — Michael D. Eisenberg

(57) ABSTRACT

An insert for decorating a hat, comprising a front wall, a rear wall, an upper wall, and a rear wall. The front wall has a front surface configured to be used as a display space, and is opposite to the rear wall. The upper wall is adjacent to the front wall and to the rear wall. The lower wall is adjacent to the front wall and to the rear wall, and opposite to the upper wall. The four walls surround a channel traversing the insert from lateral side to lateral side. The insert includes a gap between any two of the walls that are adjacent to each other, or splitting any one of the walls, for insertion of a part of a hat through the gap for retention of the part of the hat within the channel to cause the insert to be removably joined to the hat.

16 Claims, 19 Drawing Sheets

CUSTOMIZABLE SLIDING INSERT FOR HAT

TECHNICAL FIELD

The present invention relates to wearable accessories, and more particularly to a removable and customizable accessories for baseball-style caps.

BACKGROUND OF THE INVENTION

Hats have been used for millennia both functional and fashion purposes. The surfaces of some hats can be utilized as branding or personalization surfaces. However, other surfaces have not been utilized for branding and personalization. For example, brim's are generally not branded or personalized. Moreover, baseball caps includes rear straps-which are typically made of cloth, plastic, Velcro, or leather-which are rarely utilized as a branding or personalization surfaces.

With the surge in fan gear customization, there is a growing demand for visible, unique accessories that can be added post-production. Existing options, such as embroidered names or stitched patches, lack flexibility and are costly for consumers and retailers. There is an unmet need in the market for an easily attachable, removable, and reusable solution that allows fans, sports teams, brands, and individuals to display personal messages, logos, or numbers on their headwear in a cost-effective and interchangeable manner.

BRIEF SUMMARY OF EMBODIMENTS OF THE INVENTION

The invention relates to a sliding insert designed to be compatible with many hats, such as baseball-style caps, for example. The sliding insert is designed to be removably joined to a hat's band or brim, to the side of the crow, to the bill, or to the rear strap of a baseball cap.

This insert slides snugly to the hat and may sit flush against the hat's curvature, staying secure through tension or optional locking grooves. The outside-facing surface of the insert is customizable (for example, with player names and numbers, team logos, slogans, or sponsor branding). The insert is easily removable, allowing users to change inserts based on events, seasons, or preferences.

Therefore, an aspect of some embodiments of the present invention relates to an insert for decorating a hat, the insert comprising a front wall, a rear wall, an upper wall, and a lower wall. The front wall has a front surface configured to be used as a display space. The rear wall opposite the front wall. The upper wall is adjacent to the front wall and to the rear wall. The lower wall is adjacent to the front wall and to the rear wall, and opposite to the upper wall. The front wall, the rear wall, the upper wall, and the lower wall surround a channel traversing the insert from lateral side to lateral side. The insert includes a gap located between any two of the walls that are adjacent to each other, or splitting any one of the walls, for insertion of a part of a hat through the gap for retention of the part of the hat within the channel to cause the insert to be removably joined to the hat.

In a variant, the insert is semi-rigid and elastic, such that the gap can be enlarged by pulling portions of the insert separated by the gap away from each other, wherein the portions of the insert separated by the gap return to an equilibrium distance from each other when no force is applied thereto.

In another variant, the gap separates: the front wall from the upper wall; or the front wall from the lower wall; or the rear wall from the upper wall; or the rear wall from the lower wall.

In yet another variant, at least one of the walls separated by the gap from one of the adjacent walls has a section closest to the gap having rounded corners.

In yet another variant, the front wall is configured to have an image printed, etched, or heat stamped on an outer surface thereof.

In a further variant, the rear wall is configured to have an image printed, etched, or heat stamped on an outer surface thereof.

In yet a further variant, at least one of the front wall and the rear wall has respective lateral edges that are curved.

In a variant, the gap separates the rear wall from the top wall and the top wall comprises a jutting extending downward from a bottom surface of the top wall, such that the rear wall is configured to be pushed toward the front wall and snap frontwards past the jutting and the jutting is configured to stop the rear wall from returning to an equilibrium position thereof. Or, the gap separates the rear wall from the bottom wall and the bottom wall comprises a jutting extending upward from a top surface of the bottom wall, such that the rear wall is configured to be pushed toward the front wall and snap frontwards past the jutting and the jutting is configured to stop the rear wall from returning to the equilibrium position thereof.

In another variant, the insert is made of an injection-molded plastic.

In yet another variant, the insert comprises Acrylonitrile Butadiene Styrene.

In a further variant, the insert comprises metal.

In yet a further variant, the gap separates the rear wall from upper wall; the upper wall has a nook on a bottom surface thereof; the rear wall has a protrusion extending from a front surface of the rear wall, the protrusion being shaped to snap to the nook.

In a variant, the gap separates the rear wall from lower wall; the lower wall has a nook on a top surface thereof; the rear wall has a protrusion extending from a front surface of the rear wall, the protrusion being shape to snap to the nook.

In another variant: if the gap separates the front wall from upper wall, the front wall is shorter than the rear wall; if the gap separates the front wall from the lower wall, the front wall is shorter than the rear wall; if the gap separates the rear wall from the upper wall, the rear wall is shorter than the front wall; if the gap separates the rear wall from the lower wall, the rear wall is shorter than the front wall.

In yet another variant: if the gap separates the front wall from upper wall, the upper wall is shorter than the lower wall; if the gap separates the front wall from the lower wall, the lower wall is shorter than the upper wall; if the gap separates the rear wall from the upper wall, the upper wall is shorter than the lower wall; if the gap separates the rear wall from the lower wall, the lower wall is shorter than the upper wall.

In a further variant, the bottom wall or the upper wall is split by the gap.

In yet a further variant, a top profile of the insert is curved.

In a variant, the portion of the hat includes a rear strap of a baseball cap.

Another aspect of some embodiments of the present invention relates to an insert for decorating a hat, the insert comprising a front wall, a rear wall, and a hinge mechanism. The front wall has a front surface configured to be used as a display space. The rear wall is opposite the front wall. The hinge mechanism hingedly joins the front wall to the rear wall. The insert has a closed configuration in which the front wall and the rear wall contact each other, and an open configuration in which the front wall and the rear wall do not contact. The hinge mechanism is biased towards the closed configuration, such that a portion of a hat is insertable in a space between the front wall and the rear wall when the insert is in the open configuration and the portion of the hat is pressed between the front wall the rear wall when the rear wall and the front wall are released from the open configuration.

In a variant, a top profile of the insert is curved.

BRIEF DESCRIPTION OF THE DRAWINGS

The present invention, in accordance with one or more various embodiments, is described in detail with reference to the following figures. The drawings are provided for purposes of illustration only and merely depict typical or example embodiments of the invention. These drawings are provided to facilitate the reader's understanding of the invention and shall not be considered limiting of the breadth, scope, or applicability of the invention. It should be noted that for clarity and ease of illustration these drawings are not necessarily made to scale.

Some of the figures included herein illustrate various embodiments of the invention from different viewing angles. Although the accompanying descriptive text may refer to such views as "top," "bottom" or "side" views, such references are merely descriptive and do not imply or require that the invention be implemented or used in a particular spatial orientation unless explicitly stated otherwise.

The figures are not intended to be exhaustive or to limit the invention to the precise form disclosed. It should be understood that the invention can be practiced with modification and alteration, and that the invention be limited only by the claims and the equivalents thereof.

DETAILED DESCRIPTION OF THE EMBODIMENTS OF THE INVENTION

From time-to-time, the present invention is described herein in terms of example environments. Description in terms of these environments is provided to allow the various features and embodiments of the invention to be portrayed in the context of an exemplary application. After reading this description, it will become apparent to one of ordinary skill in the art how the invention can be implemented in different and alternative environments.

Unless defined otherwise, all technical and scientific terms used herein have the same meaning as is commonly understood by one of ordinary skill in the art to which this invention belongs. All patents, applications, published applications and other publications referred to herein are incorporated by reference in their entirety. If a definition set forth in this section is contrary to or otherwise inconsistent with a definition set forth in applications, published applications and other publications that are herein incorporated by reference, the definition set forth in this document prevails over the definition that is incorporated herein by reference.

Figure 1:
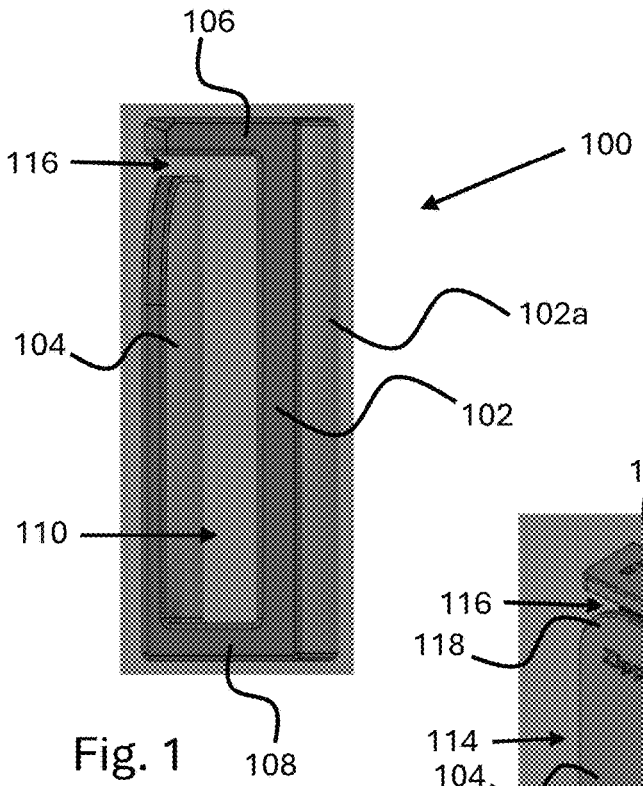
FIG. 1 is a side view of an insert for a hat, according to some embodiments of the present invention.
Figure 2:
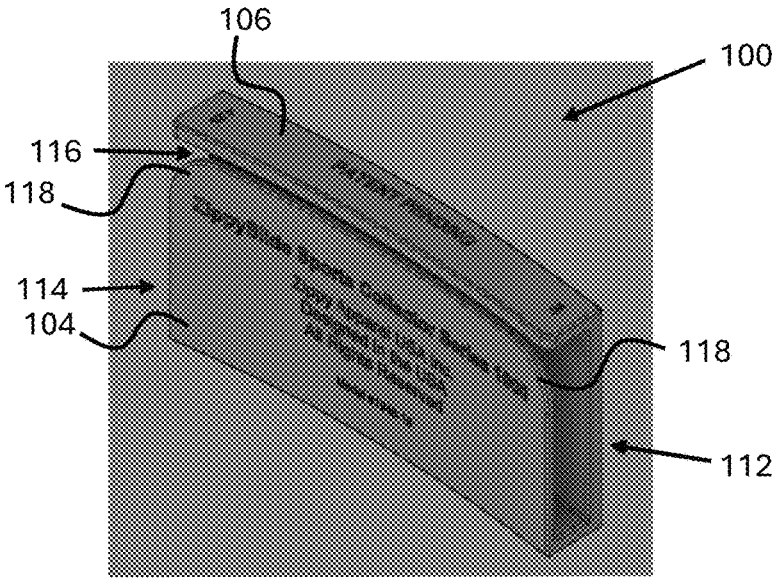
FIG. 2 is a perspective view of an insert for a hat where the rear wall has rounded corners, according to some embodiments of the present invention.

Referring now to the drawings, FIG. 1 is a side view of an insert for decorating a hat, according to some embodiments of the present invention. FIG. 2 is a perspective view of an insert for a hat where the rear wall has rounded corners, according to some embodiments of the present invention.

Figure 3:
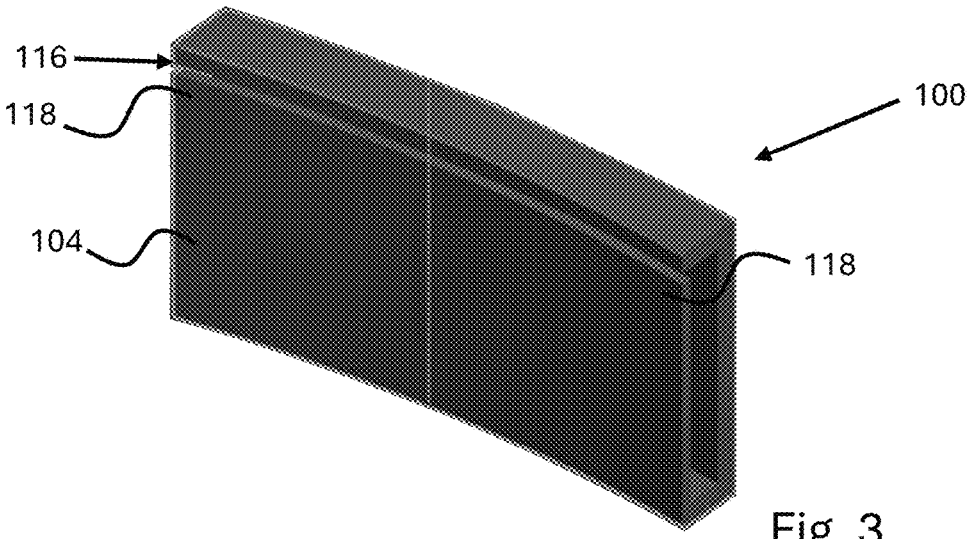
FIG. 3 is a perspective view of an insert for a hat where the rear wall has angled corners, according to some embodiments of the present invention.
Figure 4:
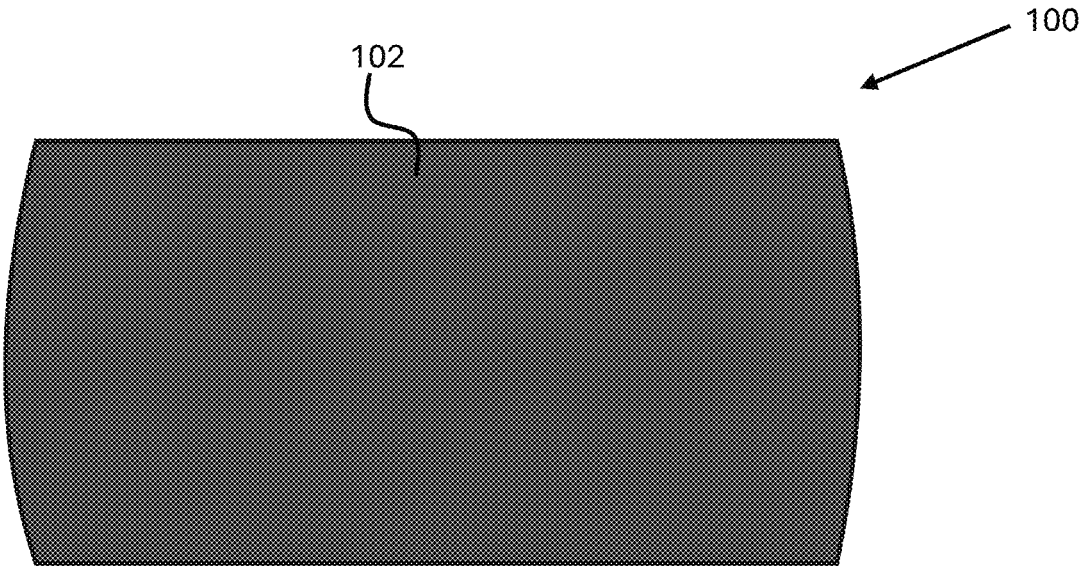
FIG. 4 is a front view of an insert for a hat in which the front wall has curved lateral edges, according to some embodiments of the present invention.
Figure 5:
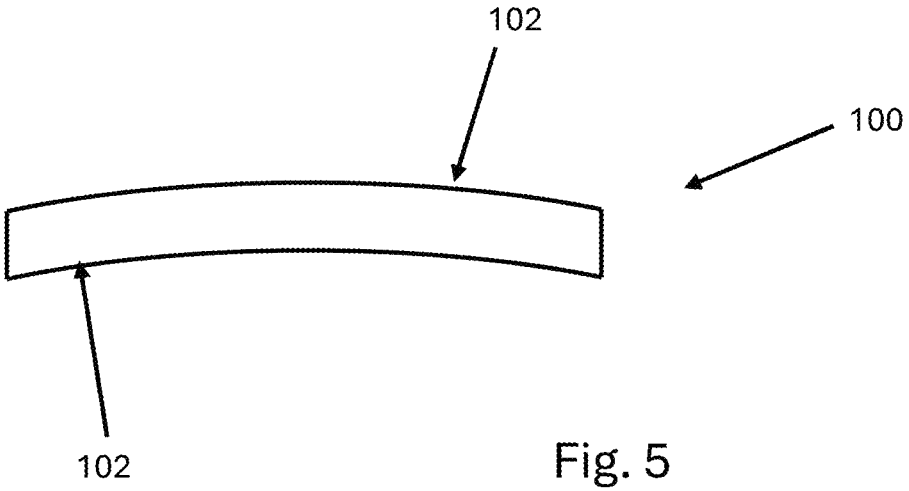
FIG. 5 is a top view of an insert for a hat having a curved profile, according to some embodiments of the present invention.

FIG. 3 is a perspective view of an insert for a hat where the rear wall has angled corners, according to some embodiments of the present invention. FIG. 4 is a front view of an insert for a hat in which the front wall has curved lateral edges, according to some embodiments of the present invention. FIG. 5 is a top view of an insert for a hat having a curved profile, according to some embodiments of the present invention.

The insert 100 includes a front wall 102, a rear wall 104, and upper wall 106, and a lower wall 108. The front wall 102 has a front surface 102*a* configured to be used as a display space. The rear wall 104 is opposite the front wall 102. The upper wall 106 is adjacent to the front wall 102 and to the rear wall 104. The lower wall 108 is adjacent to the front wall 102 and to the rear wall 104 and oppose the upper wall 106. The front wall 102, the rear wall 104, the upper wall 106, and the lower wall 108 surround a channel 110 traversing the insert from a first lateral side 112 to a second lateral side 114 of the insert 100. The lateral sides 112 and 114 of the insert 100 are open, such that an object can traverse the insert 100 via the channel 110.

The insert 100 has a gap 116 located between any two of the walls (102, 104, 106, 108) that are adjacent to each other, or splitting any one of the walls. A part of a hat can be inserted through the gap 116 in the channel 110 for retention of the part of the hat within the channel. In this manner, the insert to be removably joined to the hat. In the examples of FIGS. 1-3, the gap 116 is between the rear wall 104 and the upper wall 106. As will be seen further below, gap 116 may be located elsewhere, as noted above (i.e., between any two walls or splitting any one of the walls).

In some embodiments of the present invention, the insert 100 is semi-rigid and elastic. The gap 116 can be enlarged by pulling portions of the insert separated by the gap away from each other. When no force is applied any longer to the portions of the insert separated by the gap, the portions separated by the gap return to equilibrium positions thereof. In this manner, the portion of the hat is inserted into the insert's channel via the enlarged gap and cannot easily leave the channel via the gap when the portions separated by the gap return to equilibrium positions thereof such that the gap is no longer enlarged.

In some embodiments of the present invention, at least one of the walls separated by the gap 116 has a portion closest to the gap sporting rounded corners 118, as seen in FIG. 2. In this manner, the gap is larger at the lateral sides, making it easier to introduce a part of the hat into channel via the gap when the gap is enlarged. Alternatively, the corners 118 are angles, as seen in FIG. 3.

In some embodiments of the present invention, the front wall and/or the rear wall has respective lateral edges that are curved, as seen inf FIG. 4. This shape may be more pleasant to the eye and add to the decorative value of the insert 100.

In some embodiments of the present invention a top profile of the insert is curved, as seen in FIG. 5. In this manner, the front wall 102 and rear wall 104 curve to conform to a curvature of the hat. This decreases any discomfort that may be created by placing the insert on a hat. The front surface of the front wall has a convex shape, while the rear surface of the rear wall has a concave shape.

The insert 100 may be made of an injection-molded plastic, such as Acrylonitrile Butadiene Styrene (ABS), for example. ABS can be easily printed upon via ultraviolet (UV) printing techniques and can also be easily heat stamped. Alternatively, the insert may be made of metal. The insert may be made of any material that can be etched, printed on, or heat stamped. An image may be etched, printed on, heat stamped, or otherwise displayed on the front surface 102*a* which faces outward when the insert is joined to the hat. Etching, printing, and heat stamping are examples of reproducing an image on the insert's surfaces. Other techniques for reproducing an image on a surface are within the scope of the present invention.

Figure 45:
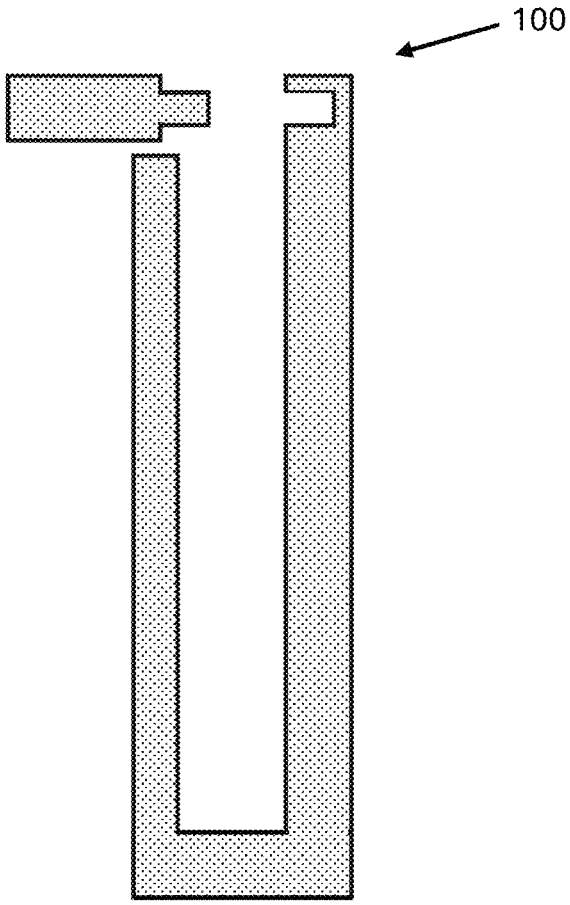
FIGS. 45 and 46 are examples of inserts fabricated in two parts and joined via a tenon and mortise joints.
Figure 46:
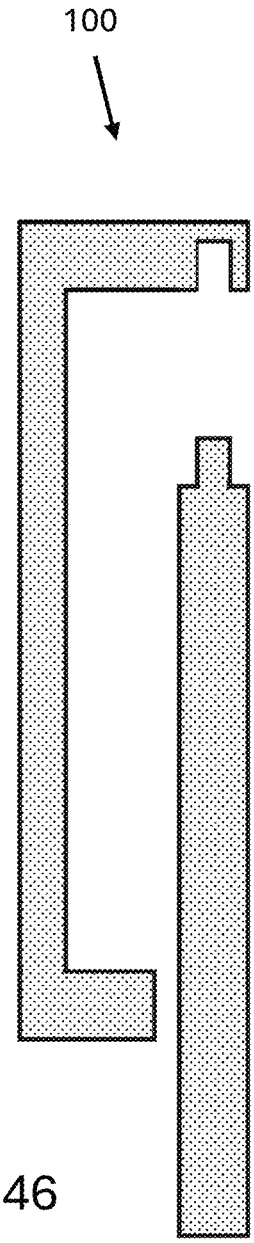

In some embodiments of the present invention, the insert 100 may be fabricated as a unitary piece from a single mold. In other embodiments of the present invention, the insert may be fabricated as two pieces from respective molds, The two pieces are joined together via a mortise and tenon joint to form the insert 100, as seen in the examples of FIGS. 45 and 46. In some embodiments of the present invention, one of the pieces is a wall adjacent to the gap, while the second piece includes the remaining walls.

The insert 100 may be used, for example, for one of the following purposes:

1. Sports fans adding player names and numbers (e.g., "JUDGE 99" or "MARNER 16")
2. Corporate branding at events (e.g., Coca-Cola logo during a sponsored tournament)
3. Golf clubs offering branded cap accessories at their pro shops
4. Concert or campaign staff wearing interchangeable messaging on caps
5. Fans collecting limited-edition inserts as memorabilia An image, a logo, or writing may be etched, printed on, or heat stamped on the rear surface 104, as seen in FIG. 2. The image, a logo, or writing on the rear surface may include the name of the manufacturer of the insert or any other information. If the insert is a limited-edition insert, writing may be on the rear wall to identify the insert as a limited-edition collectible. For example, if 100 copies of a certain limited-edition insert were made, the writing on the rear wall may be used to identify which of 100 copies the insert is. For example: "Limited Edition Toronto Maple Leafs™ Logo—2024-2025 Season—Copy 34/100".

The rectangular shape of the insert 100 ensures that the image/logo on the front surface 102*a* of the front wall 102 is displayed in the correct orientation when the insert is joined to the hat. Moreover, the rear wall 104 (which contacts the user's head in some uses thereof) is substantially parallel to the front wall 102 and optionally curves to match the hat's curvature, to make sure the insert is comfortable against the user's head, while at the same time maintaining the image on the front wall in the correct orientation.

FIGS. 6 to 9 are side cross-sectional views of the insert 100 for a hat showing how a part of the hat is introduced into the channel, according to some embodiments of the present invention.

Figure 6:
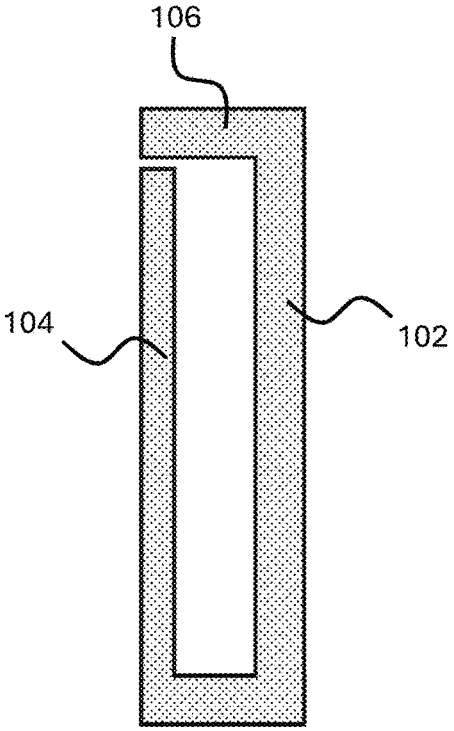
FIGS. 6 to 9 are side cross-sectional views of the insert for a hat showing how a part of the hat is introduced into the channel, according to some embodiments of the present invention.
Figure 7:
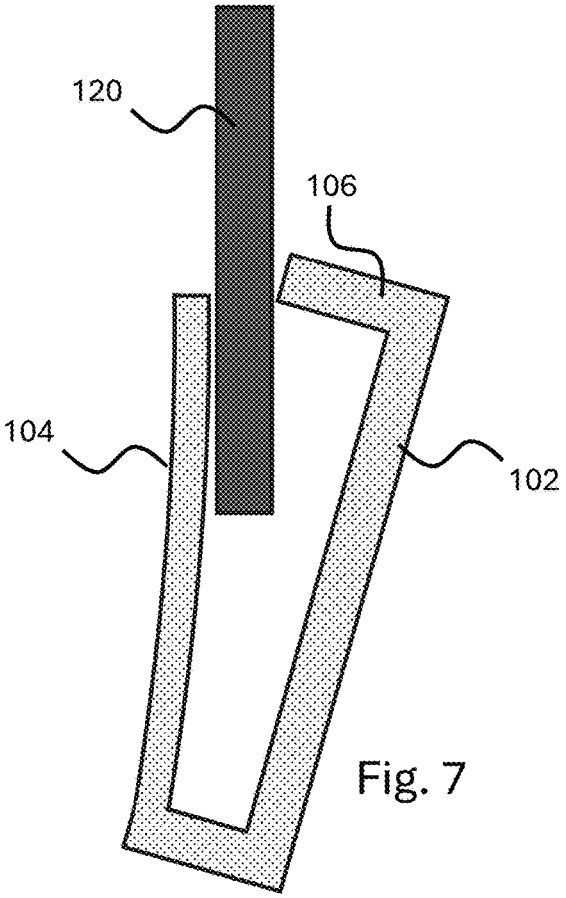

In the example of FIGS. 6-9, the gap 116 separates the rear wall 104 from the upper wall 106. In FIG. 6, the insert is in its equilibrium configuration. In FIG. 7, the rear wall is pulled away from the upper wall, enlarging the gap. A hat's part 120 is inserted into the channel 110 via the enlarged gap.

Figure 8:
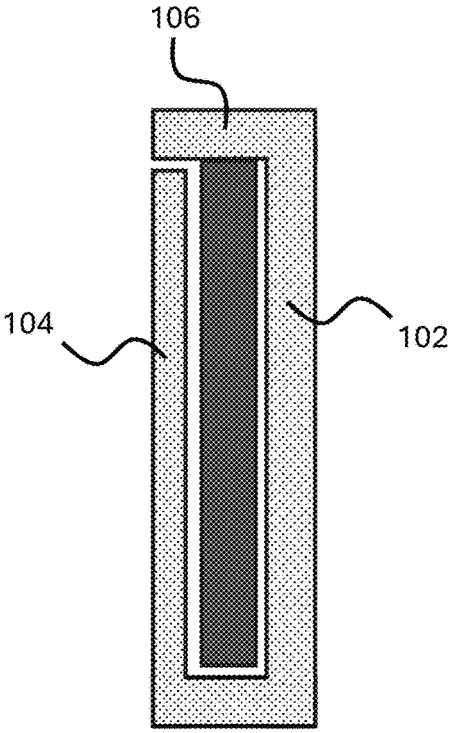
Figure 9:
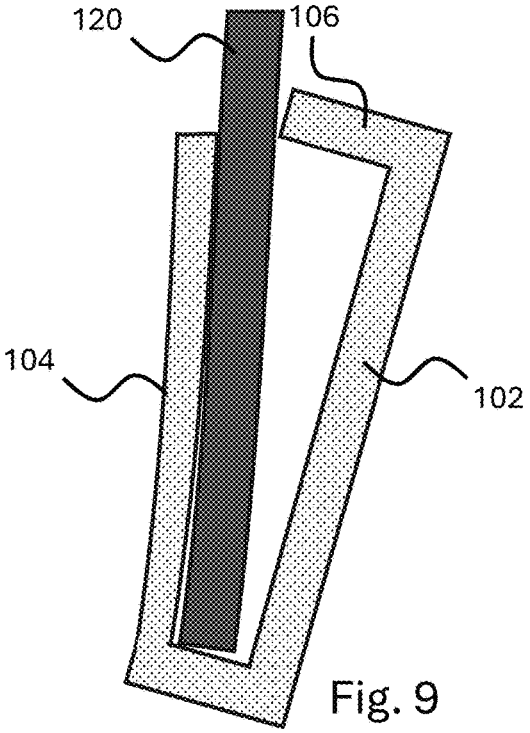
Figure 41:
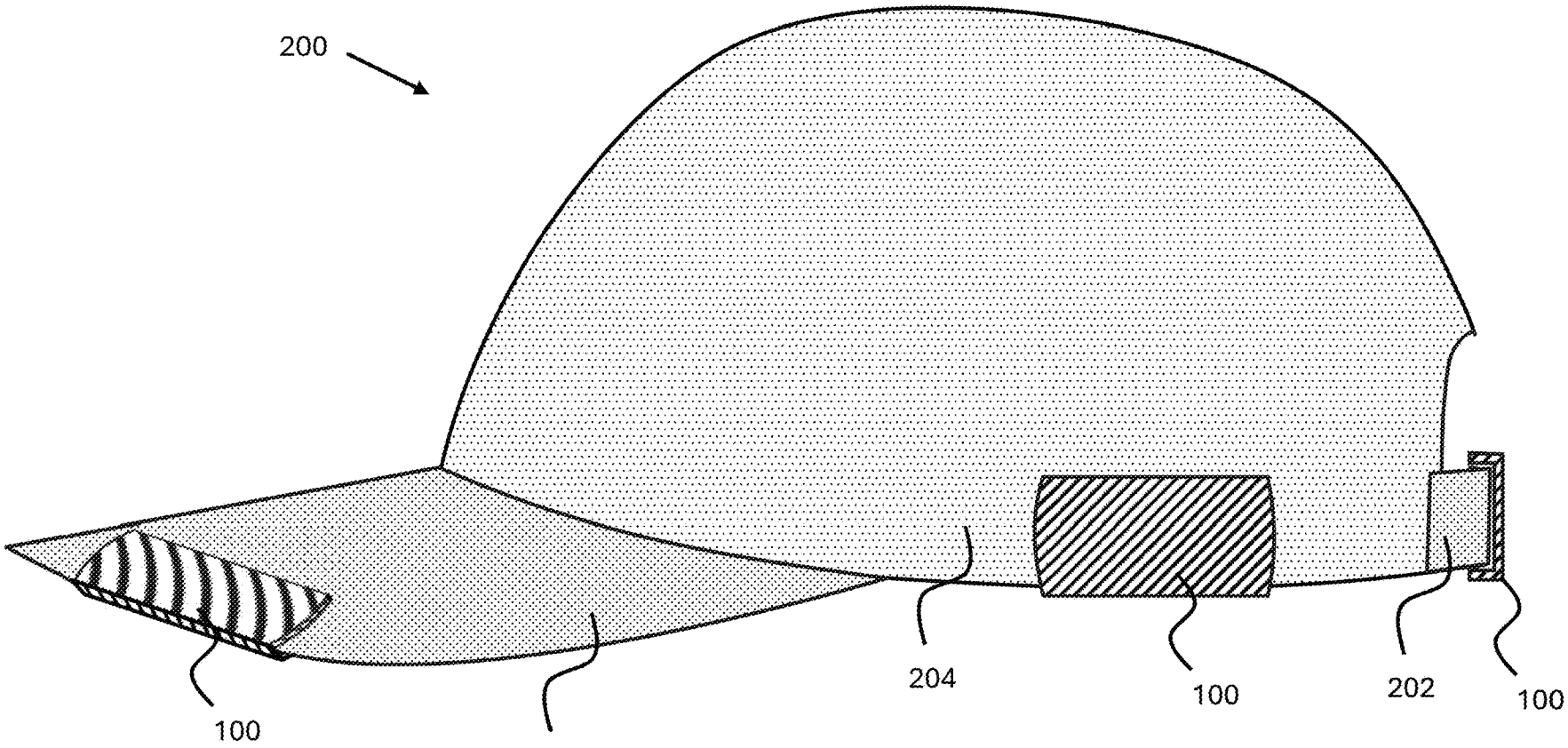
FIG. 41 illustrates examples of the placement of the insert on a baseball cap, according to some embodiments of the present invention.
Figure 42:
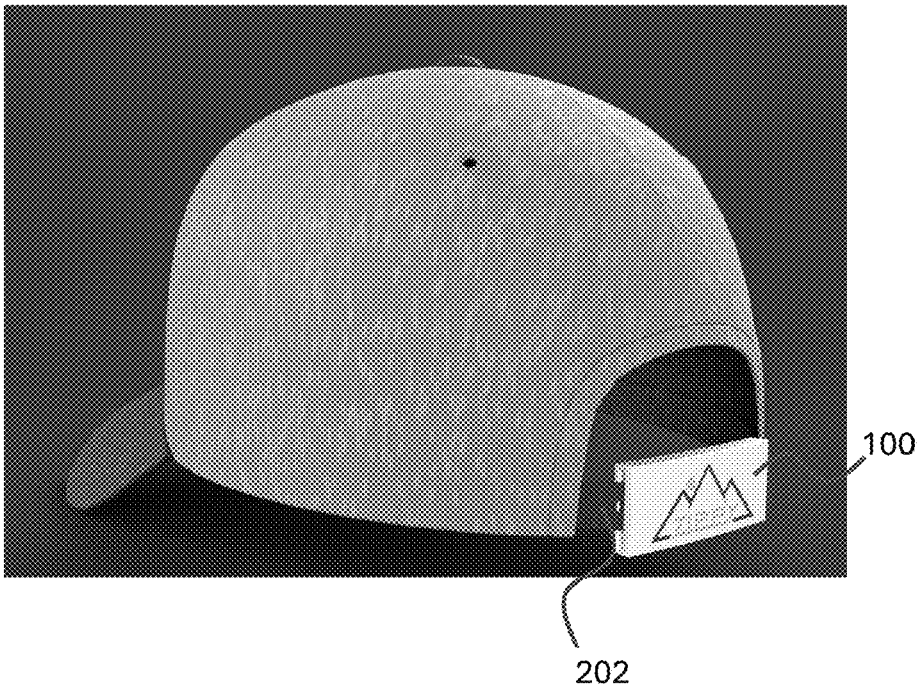
FIGS. 42-43 illustrate examples of the placement of the insert on the rear strap of a baseball cap, according to some embodiments of the present invention.
Figure 43:
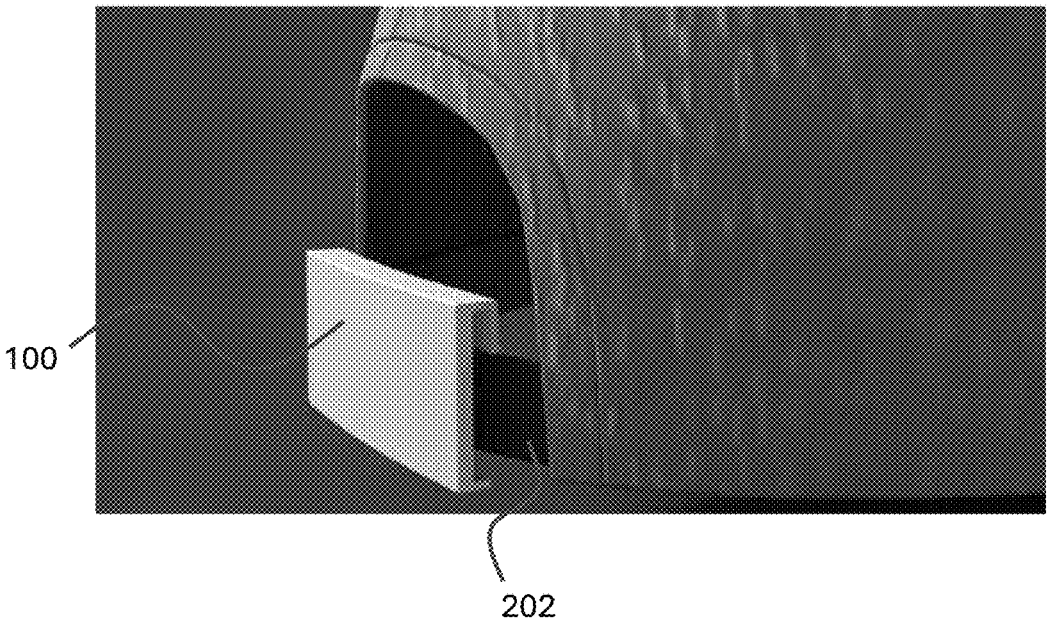
Figure 44:
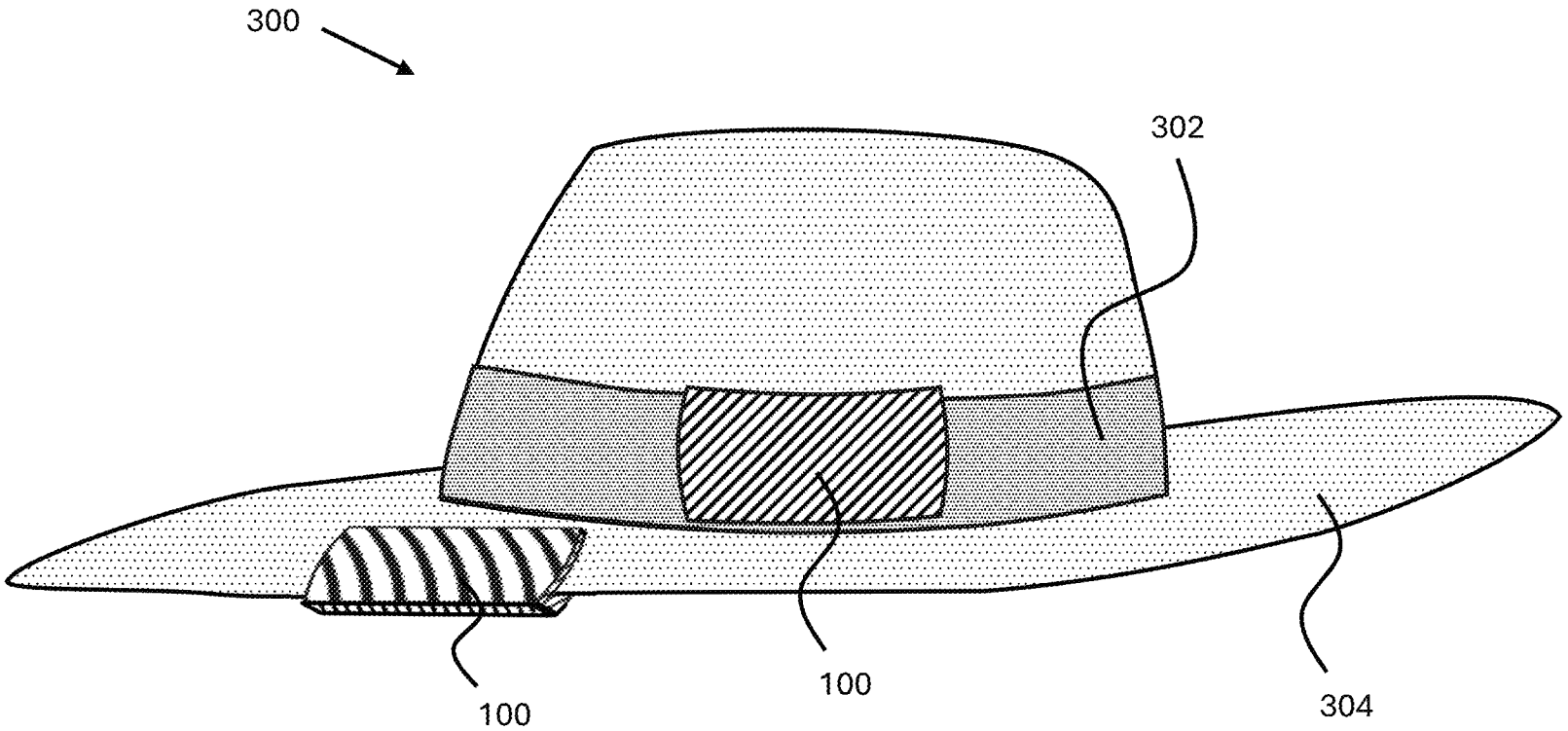
FIG. 44 illustrates examples of the placement of the insert on a hat having a crown and brim, according to some embodiments of the present invention.

If the hat's part 120 fits into the channel 110, the rear wall is 104 is released and returns to its equilibrium position, as seen in FIG. 8. In this manner, the hat's part 120 is surrounded by all four walls and cannot leave the insert unless the gap is enlarged again by applying force of the rear wall 104. In this manner, the insert 100 is removably joined to the hat. An example of a hat's part that fits into the channel is the rear strap 202 of a baseball cap 200, as seen in FIGS. 41, 42, and 43, or the band 302 of a brimmed hat 300, as seen in FIG. 44.

If the hat's part 120 is longer than the vertical dimension of the channel 110, the hat's part 120 is partially inserted into the channel 110 and the rear wall is released. The rear wall presses a portion of the hat's part to the upper wall 106, making it hard to remove the insert from the hat without pulling the rear wall away from the upper wall. In this manner, the insert 100 is removably joined to the hat. An example of a hat's part that does not fully fit into the channel and is held via compression includes the crown 204 or the visor 206 of a baseball cap 200, as shown in FIG. 41, or the band 302 or the brim 304 of a brimmed hat 300, as seen in FIG. 44.

FIGS. 10-13*b* are side cross sectional views illustrating examples of positions of the gap, according to some embodiments of the present invention.

Figure 10:
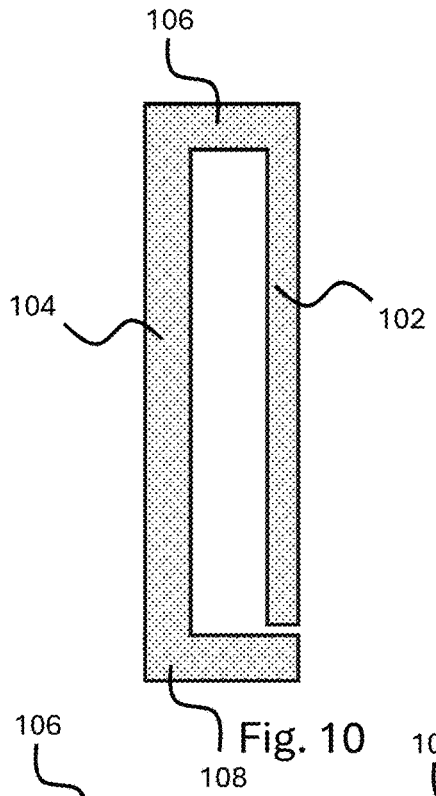
FIGS. 10-13*b* are side cross sectional views illustrating examples of positions of the gap, according to some embodiments of the present invention.
Figure 11:
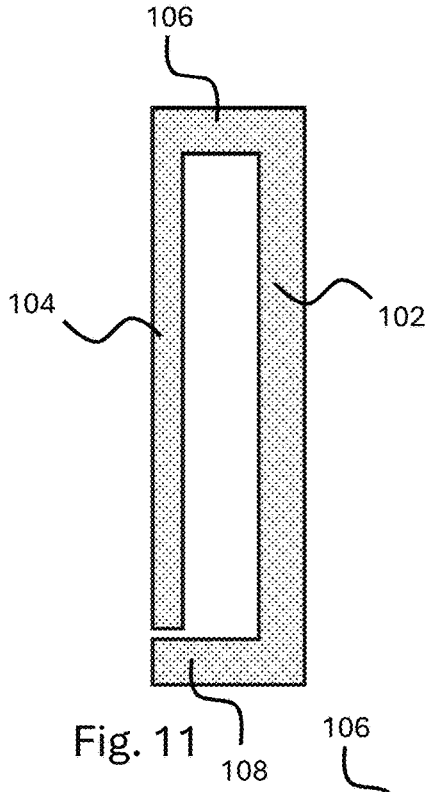
Figure 12:
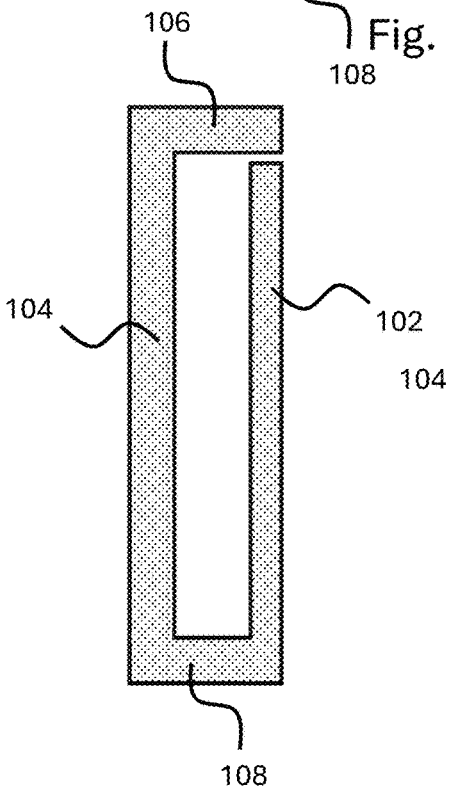
Figure 13A:
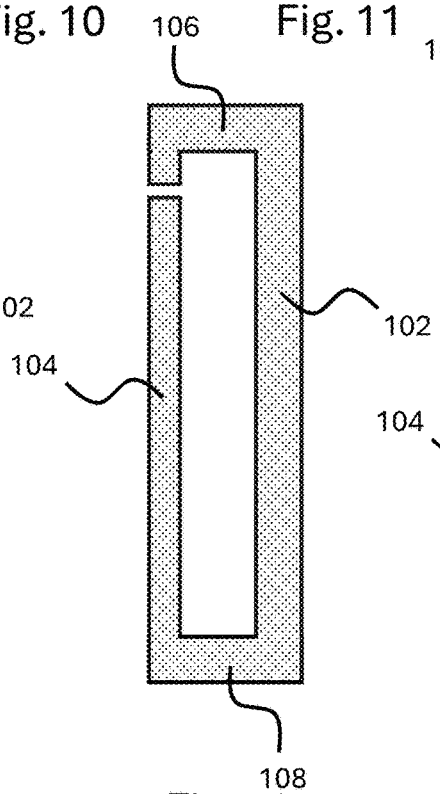
Figure 13B:
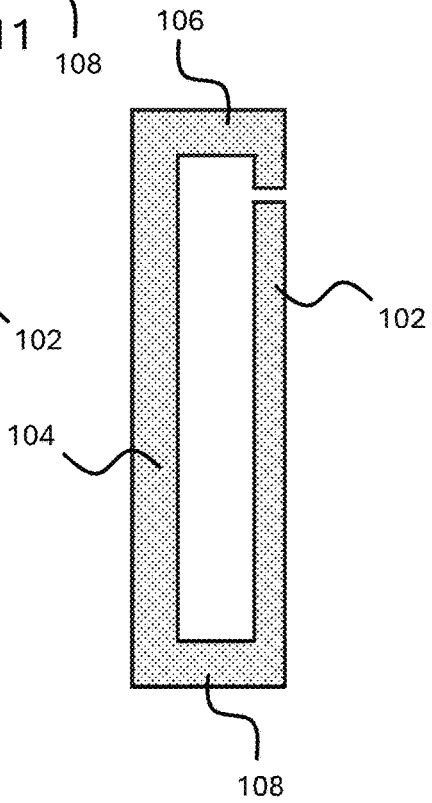

In FIGS. 10-13*b*, the gap is horizontal. The vertical wall adjacent to the gap is shorter than the opposing vertical wall. In the example of FIG. 10, the gap 116 is between the front wall 102 and the lower wall 108, and the front wall 102 is shorter than the rear wall 104. In the example of FIG. 11, the gap 116 is between the rear wall 104 and the lower wall 108, and the rear wall 104 is shorter than the front wall 102. In the example of FIG. 12, the gap 116 is between the front wall 102 and the upper wall 106, and the front wall 102 is shorter than the rear wall 104. In the example of FIG. 13*a*, the gap 116 splits the rear wall, and the rear wall 104 is shorter than the front wall 102. In the example of FIG. 13*b*, the gap 116 splits the front wall, and the front wall 102 is shorter than the rear wall 104. The location of the gap along the rear wall in FIG. 13*a* or along the front wall in FIG. 13*b* may differ. The location may be closer to the upper wall, around the middle, or closer to the lower wall.

Figure 15:
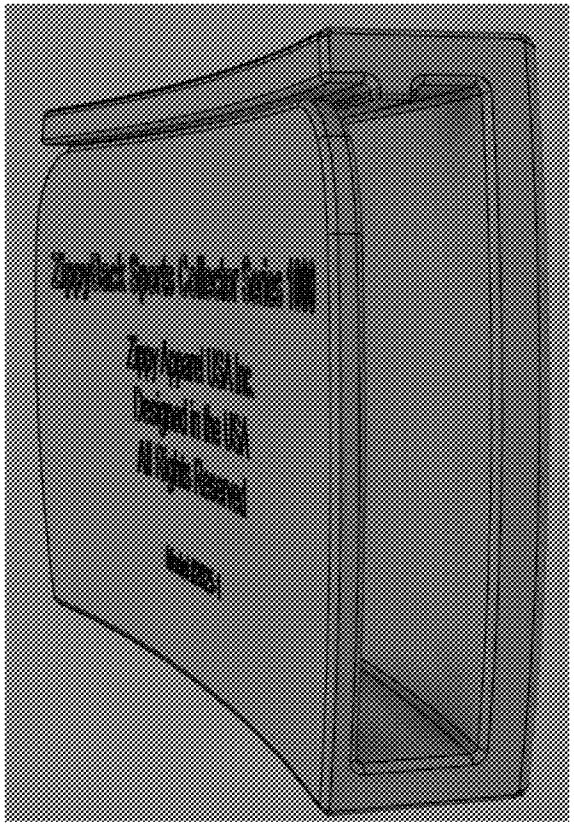
FIGS. 14 and 15 are perspective views of an insert for a hat having an vertically extending jutting, according to some embodiments of the present invention.
Figure 14:
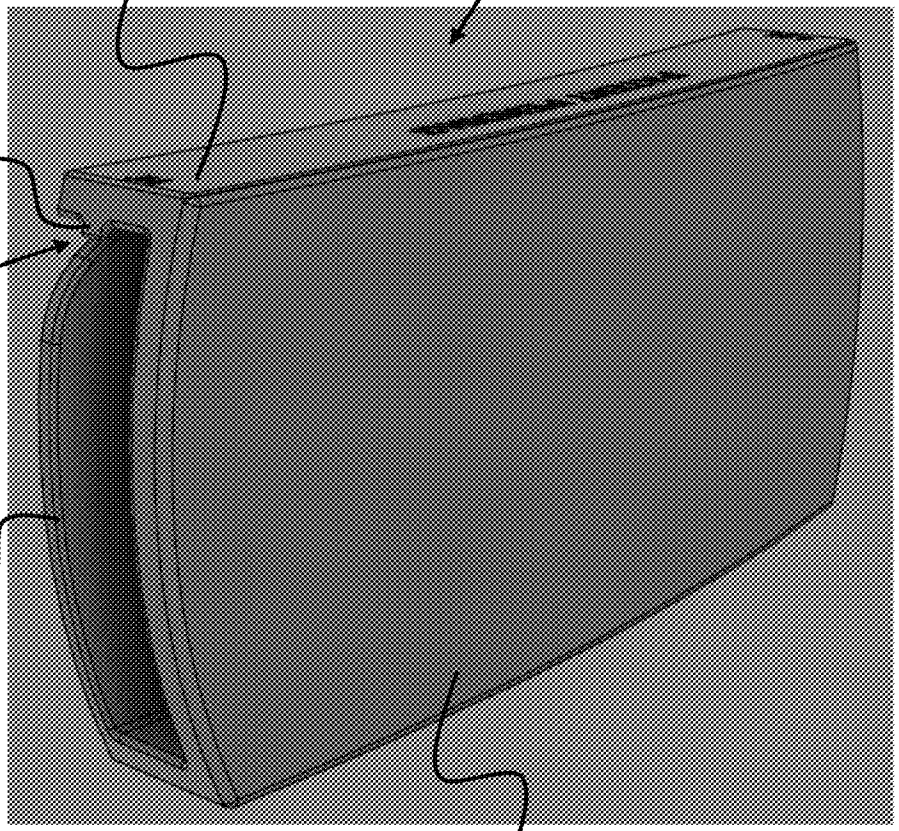
Figure 20:
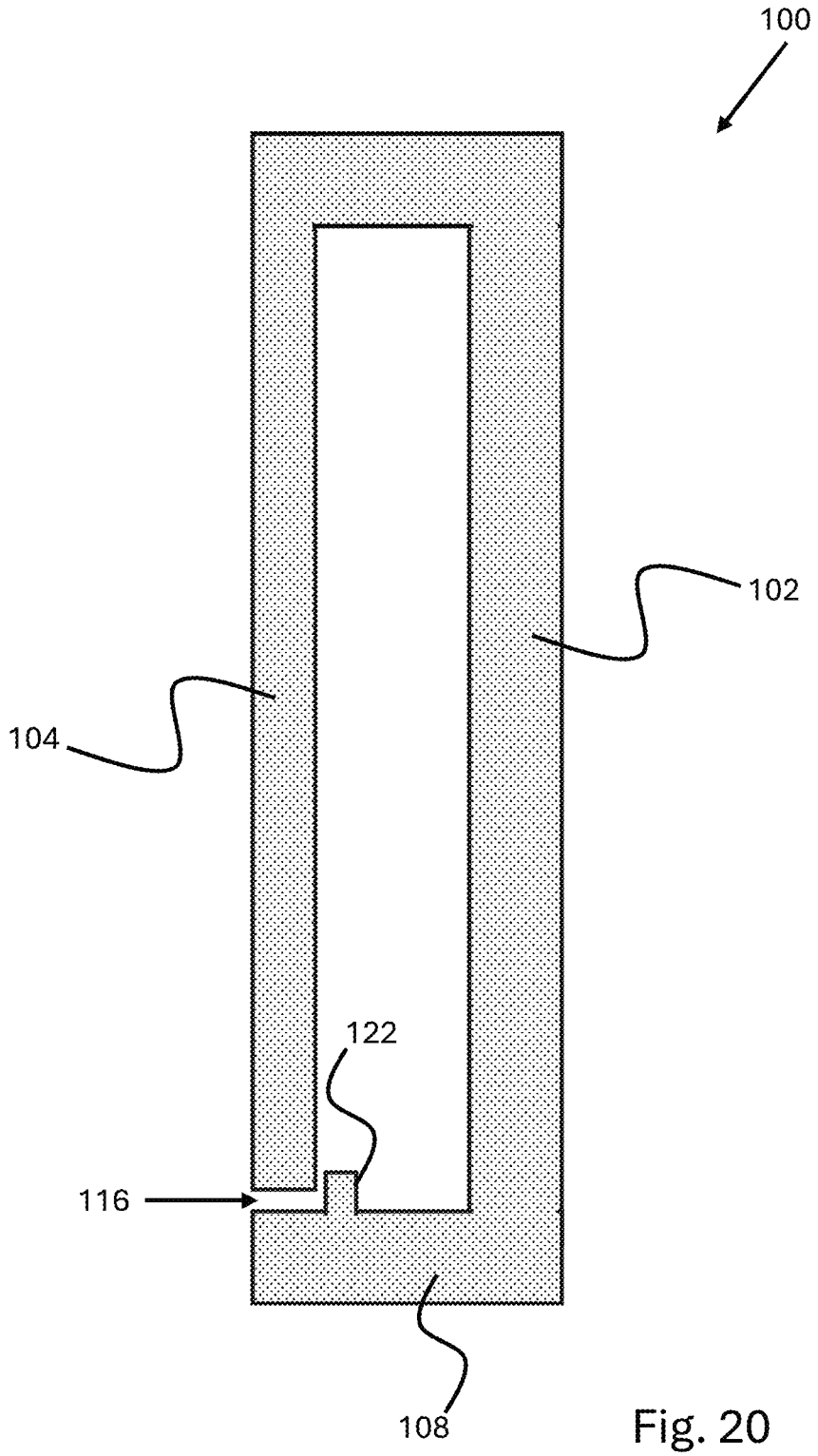
FIG. 20 illustrates an example of an alternate positioning of the gap and jutting, according to some embodiments of the present invention.

FIGS. 14 and 15 are perspective views of an insert for a hat having an vertically extending jutting, according to some embodiments of the present invention. FIG. 20 illustrates an example of an alternate positioning of the gap and jutting, according to some embodiments of the present invention;

The insert 100 of FIGS. 14 and 15 is similar to the insert described in FIGS. 1-5. In addition the insert 100 of FIGS. 14 and 15 has a jutting 122. In the example of FIGS. 14-15, the gap 116 separates the rear wall 104 from the top wall 106. The top wall 106 includes a jutting 122 extending downward from the bottom surface of the top wall 106. The rear wall 104 is configured to be pushed toward the front wall 102 and snap frontwards past the jutting 122, such and the jutting 122 is configured to stop the rear wall 104 from returning to an equilibrium position thereof. It should be noted that the gap may separate the front wall 102 from the upper wall 106, and the front wall may be pushed toward the rear wall 104 and snap rearwards past the jutting 122, such and the jutting 122 is configured to stop the front wall from returning to an equilibrium position thereof.

In another embodiment of the present invention, as seen in FIG. 20, the gap 116 separates the rear wall 104 from the bottom wall 108, and the bottom wall 108 includes a jutting 122 extending upward from the top surface of the bottom wall 108. It should be noted that the gap may separate the front wall 102 from the lower wall 108, and the front wall may be pushed toward the rear wall 104 and snap rearwards past the jutting 122, such and the jutting 122 is configured to stop the front wall from returning to an equilibrium position thereof.

The jutting enables changing the size of the channel to ensure that a thinner hat part (that is thin enough to slip out of the gap) is retained in the channel 110.

FIGS. 16-19 are side cross-sectional views of the insert of FIGS. 14-15 showing how a part of the hat is introduced into the channel, according to some embodiments of the present invention.

Figure 16:
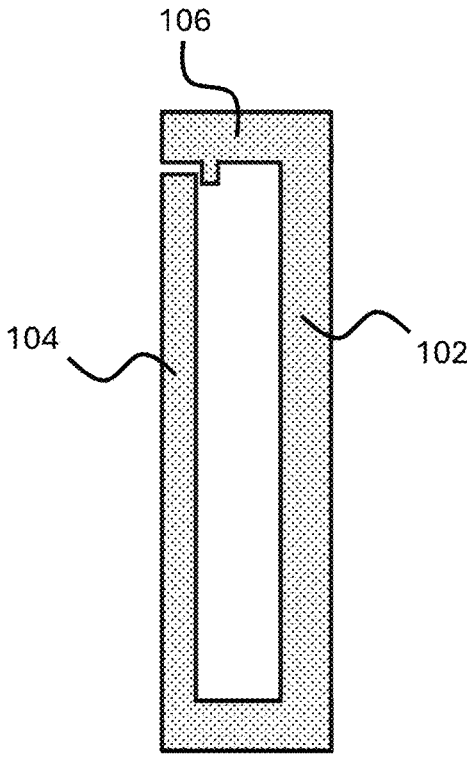
FIGS. 16-19 are side cross-sectional views of the insert of FIGS. 14-15 showing how a part of the hat is introduced into the channel, according to some embodiments of the present invention.
Figure 17:
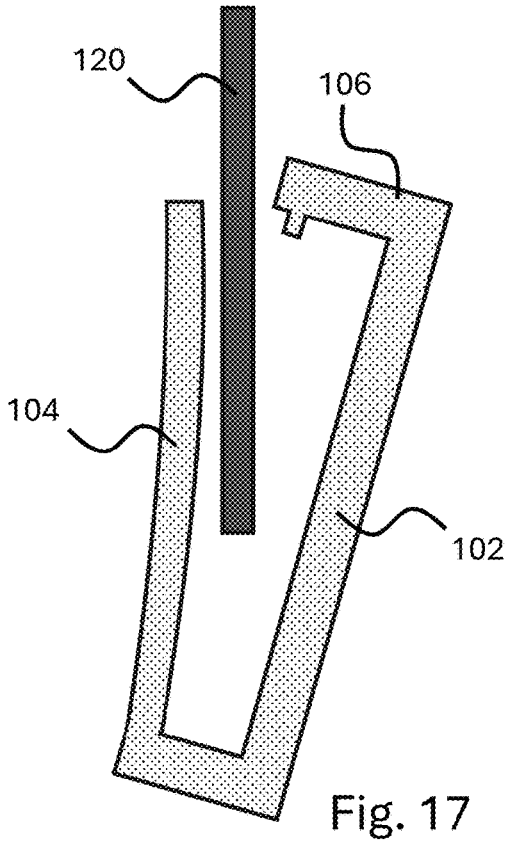

In the example of FIGS. 16-19, the gap 116 separates the rear wall 104 from the upper wall 106. In FIG. 16, the insert is in its equilibrium configuration. In FIG. 17, the rear wall is pulled away from the upper wall, enlarging the gap. A hat's part 120 is inserted into the channel 110 via the enlarged gap.

Figure 18:
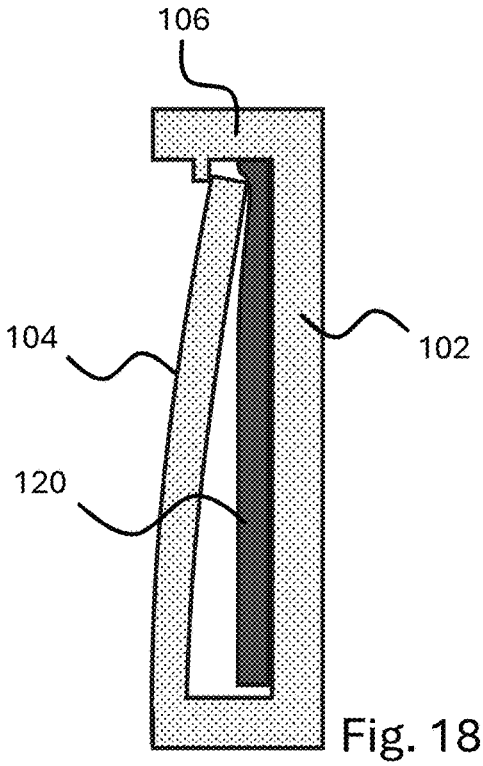

As seen in FIG. 18, if the hat's part 120 fits into the channel 110, the rear wall is 104 is pushed frontward beyond the equilibrium position to snap past the hutting 122 and effectively close the gap to prevent slippage of the hat's part 120 out of the channel via the gap. In this manner, the insert 100 is removably joined to the hat.

Figure 19:
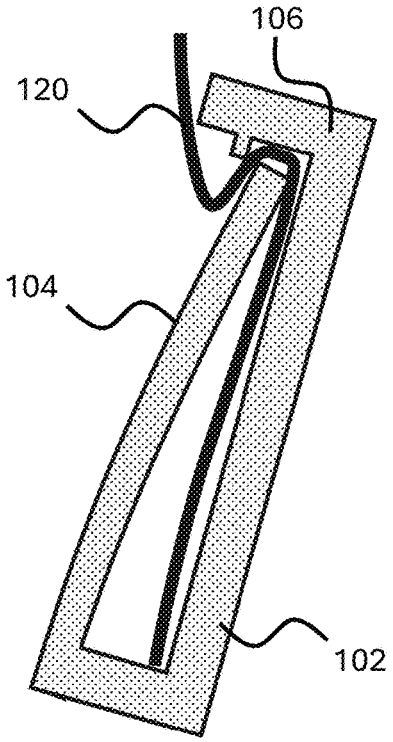

As seen in FIG. 19, if the hat's part 120 is longer than the vertical dimension of the channel 110, the hat's part 120 is partially inserted into the channel 110 and the rear wall is pushed frontward beyond the equilibrium position to snap past the hutting 122. In this manner, the hat's part is clamped between top of the rear wall and the jutting.

Figure 21:
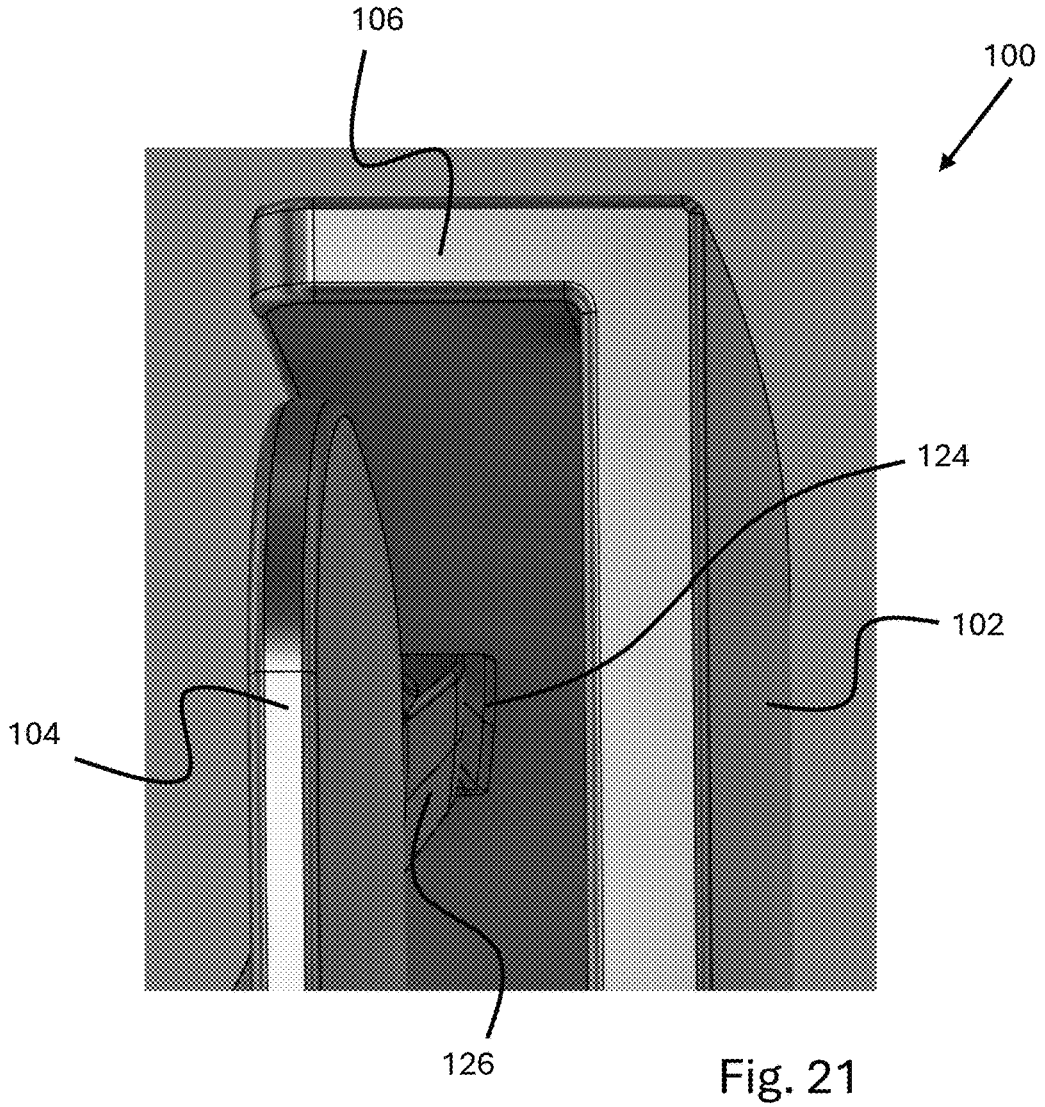
FIGS. 21-22 illustrate an insert for a hat having a nook and a protrusion, according to some embodiments of the present invention.
Figure 22:
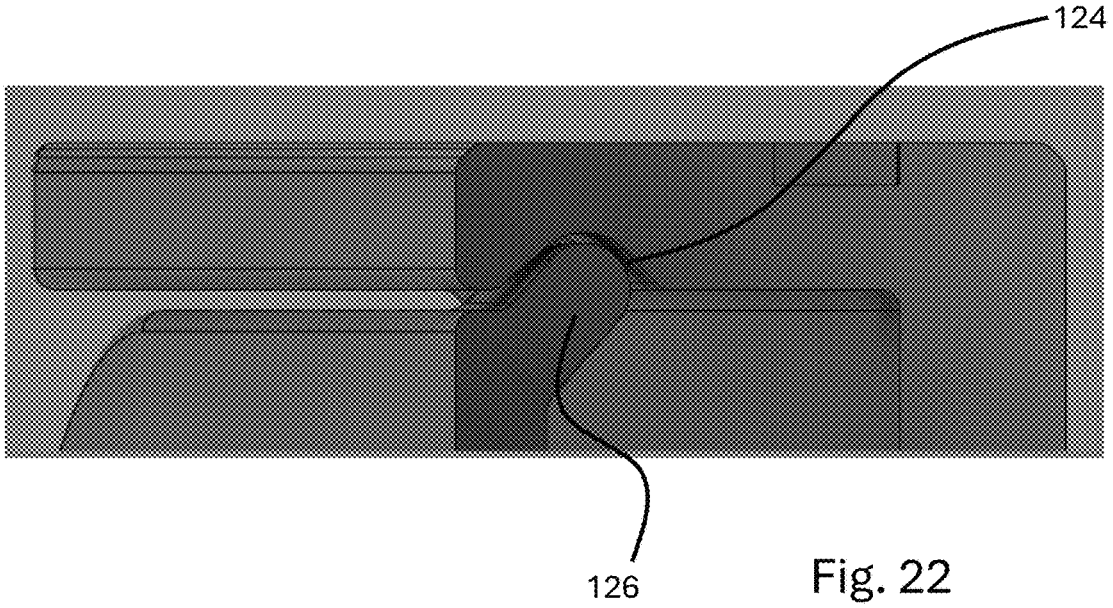
Figure 27:
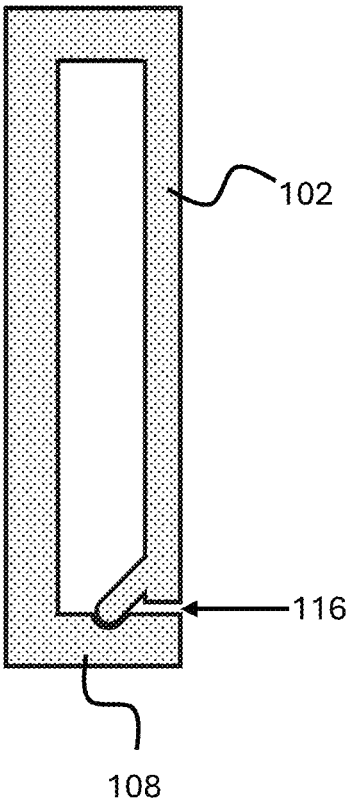
FIGS. 27-29 illustrate examples of alternate positioning of the gap, nook, and protrusion, according to some embodiments of the present invention.
Figure 28:
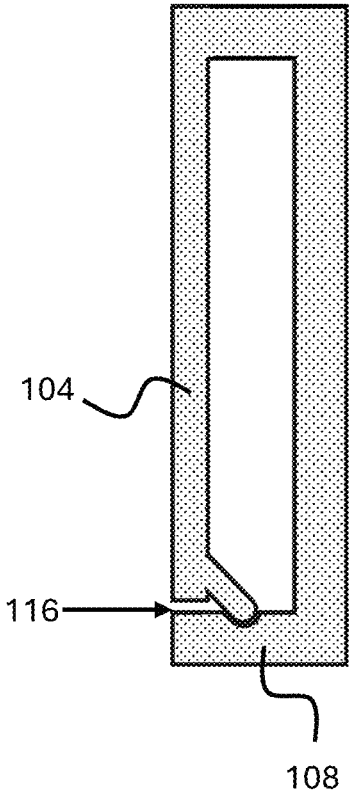
Figure 29:
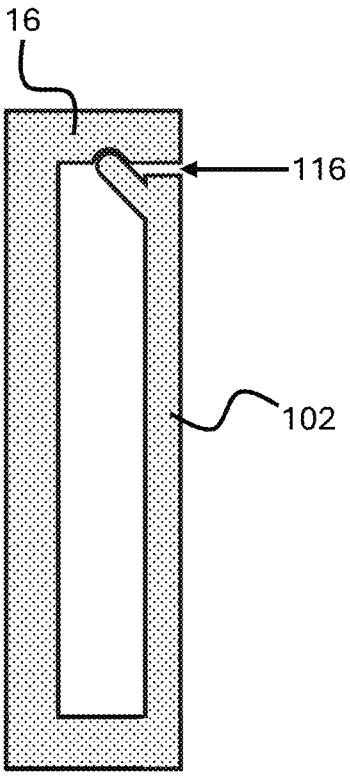

FIGS. 21-22 illustrate an insert for a hat having a nook and a protrusion, according to some embodiments of the present invention. FIGS. 27-29 illustrate examples of alternate positioning of the gap, nook, and protrusion, according to some embodiments of the present invention;

The insert 100 of FIGS. 21-22 is similar to the insert described in FIGS. 1-5. In addition the insert 100 of FIGS. 21-22 includes a nook 124 and a protrusion 126. In the example of FIGS. 21-22, the top wall 106 has a nook 124 on a bottom surface thereof, while the rear wall 104 has a protrusion 126 extending from a front surface of the rear wall 104, the protrusion being shaped to snap to the nook. In this manner, after a hat's part is introduced into the channel of the insert 110 via the gap, the rear wall returns to its equilibrium position and can be pushed so that the protrusion 126 snaps into the nook 124, closing the gap and preventing the hat's part from the leaving the channel via the gap.

It should be noted that the positioning of the nook and the protrusion may differ. For example, in FIG. 27, the gap 116 is between the front wall 102 and the lower wall 108, while the nook is on top surface of lower wall 108 and the protrusion is on the front wall 102. In the example of FIG. 28, the gap 116 is between the rear wall 104 and the lower wall 108, while the nook is on top surface of lower wall 108 and the protrusion is on the rear wall 104. In the example of FIG. 29, the gap 116 is between the front wall 102 and the upper wall 106, while the nook is on bottom surface of upper wall 106 and the protrusion is on the front wall 102.

FIGS. 23-26 are side cross-sectional views of the insert of FIGS. 21-22 showing how a part of the hat is introduced into the channel, according to some embodiments of the present invention.

Figure 23:
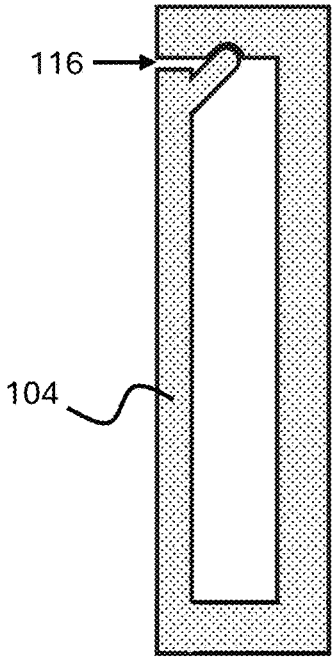
FIGS. 23-26 are side cross-sectional views of the insert of FIGS. 21-22 showing how a part of the hat is introduced into the channel, according to some embodiments of the present invention.
Figure 24:
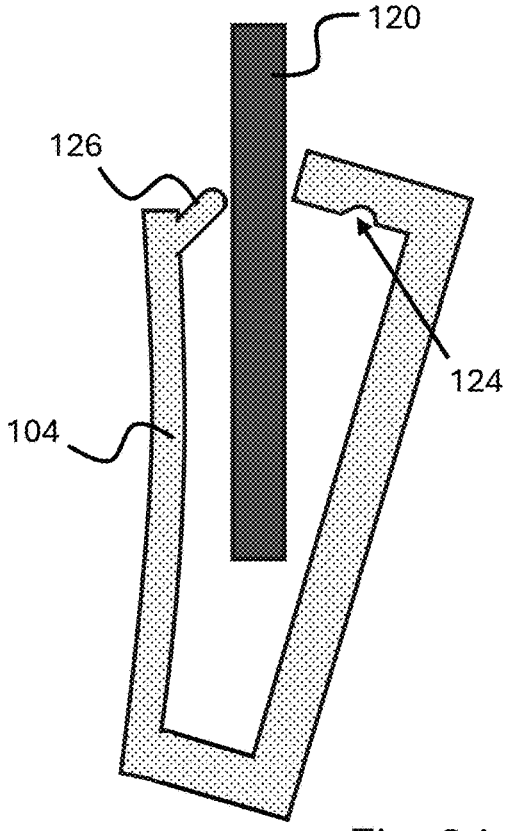

In the example of FIGS. 23-26, the gap 116 separates the rear wall 104 from the upper wall 106. The nook in on the bottom surface of the upper wall 106, while the protrusion extend forward and upward from the rear wall 104. In FIG. 23, the insert is in its equilibrium configuration, with the protrusion 126 in the nook. In FIG. 24, the rear wall is pulled away from the upper wall, snapping the protrusion out of the nook and enlarging the gap 116 to enable entry of a hat's part 120 into the channel 110 via the gap.

Figure 25:
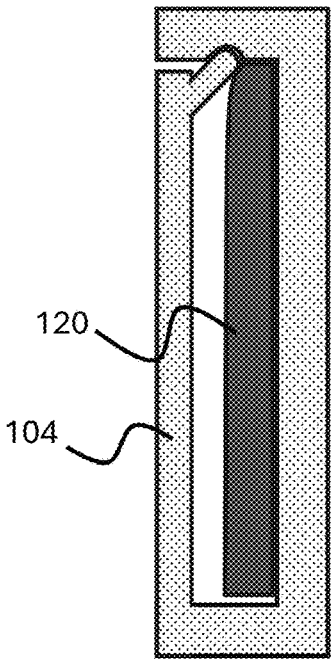

As seen in FIG. 25, if the hat's part 120 fits into the channel 110, the rear wall is 104 is pushed frontward so the protrusion 126 snaps into the nook to close the gap to prevent slippage of the hat's part 120 out of the channel via the gap. In this manner, the insert 100 is removably joined to the hat.

Figure 26:
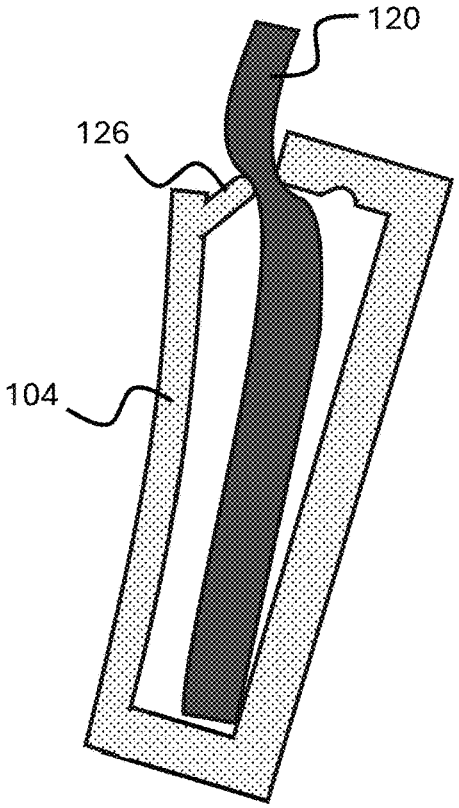

As seen in FIG. 26, if the hat's part 120 is longer than the vertical dimension of the channel 110, the hat's part 120 is partially inserted into the channel 110 and the rear wall is released such that the hat's part 120 is clamped between protrusion and the upper wall. In this manner the insert 100 is removably joined to the hat.

Figure 30:
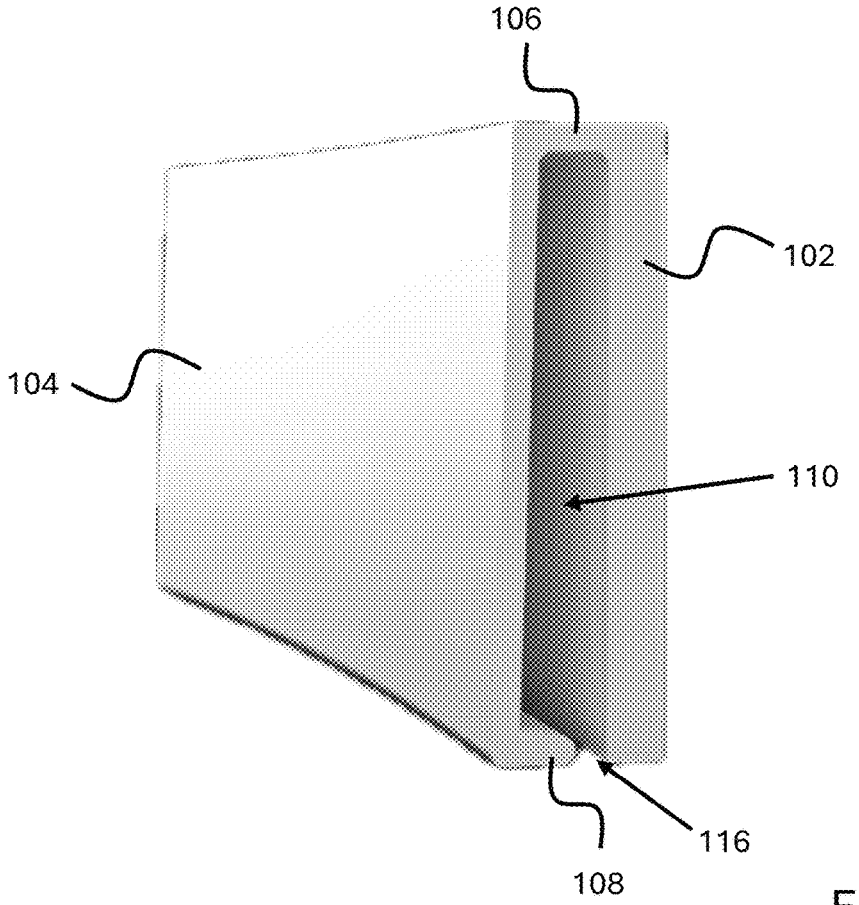
FIGS. 30-31 illustrate an insert for a hat having a vertically-extending gap, according to some embodiments of the present invention.
Figure 31:
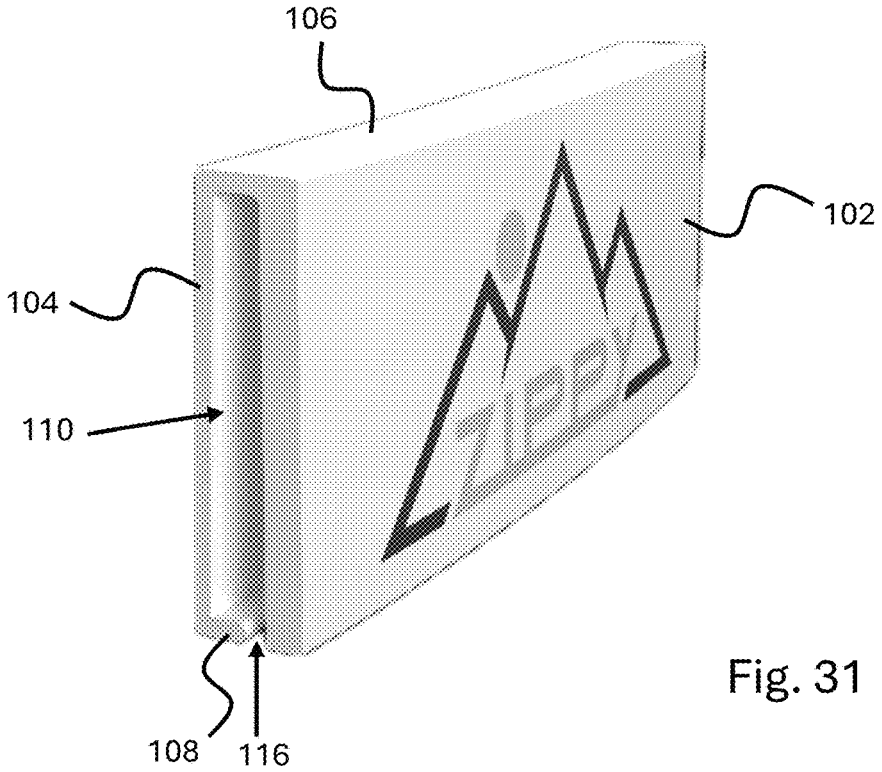

FIGS. 30-31 illustrate an insert for a hat having a vertically-extending gap, according to some embodiments of the present invention, FIGS. 36-40 illustrate examples of alternate positioning of the vertically-extending gap, according to some embodiments of the present invention.

The insert 100 of FIGS. 30-31 is similar to the insert of FIGS. 1-5 described above. In contrast with FIGS. 1-5, the insert 100 of FIGS. 30-31 has a vertically extending gap 116 between the front wall 102 and the lower wall 108. Optionally, the lower wall 108 is shorter than the upper wall.

Figure 36:
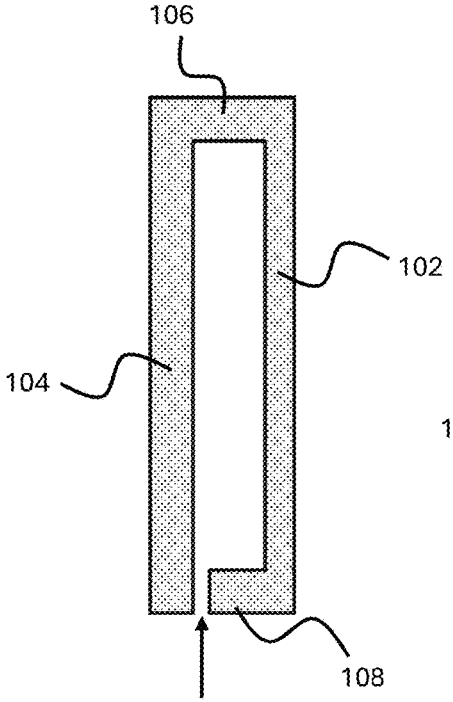
FIGS. 36-40 illustrate examples of alternate positioning of the vertically-extending gap, according to some embodiments of the present invention.
Figure 37:
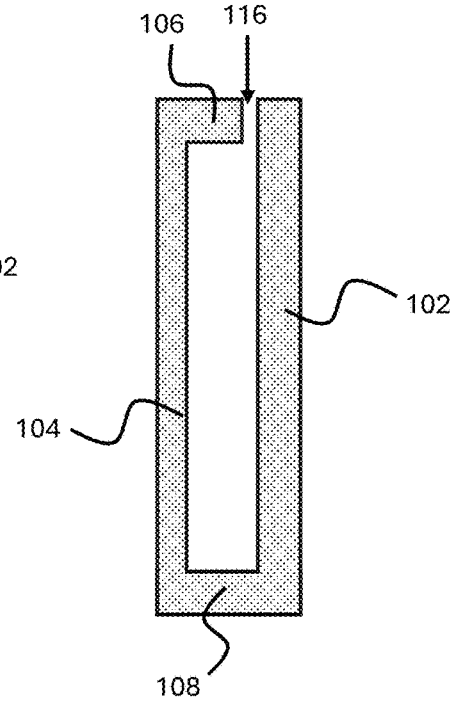
Figure 38:
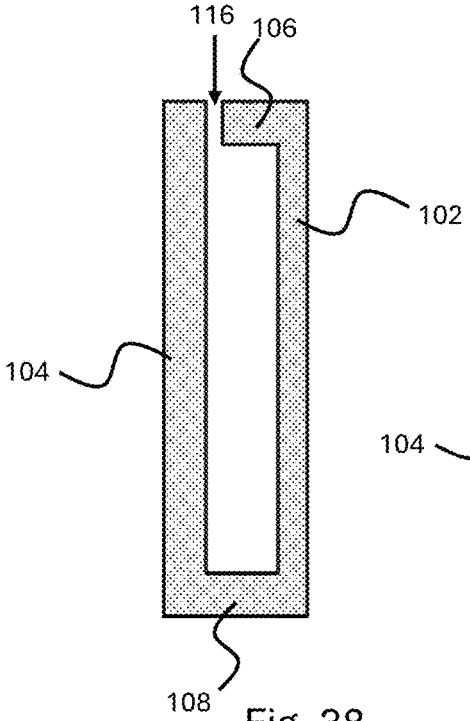

In FIG. 36, the gap 116 separates the rear wall 104 from the lower wall 108, and the lower wall 108 is optionally shorter than the upper wall 106. In FIG. 37, the gap 116 separates the front 102 wall from upper wall 106, the upper wall 106 is optionally shorter than the lower wall 108. In FIGS. 38, the gap separates the rear wall 104 from the upper wall 106, the upper wall 106 is optionally shorter than the lower wall 104. It should be noted that the embodiments of FIGS. 30-31 and 36-38 may include the protrusion and nook described above.

Figure 39:
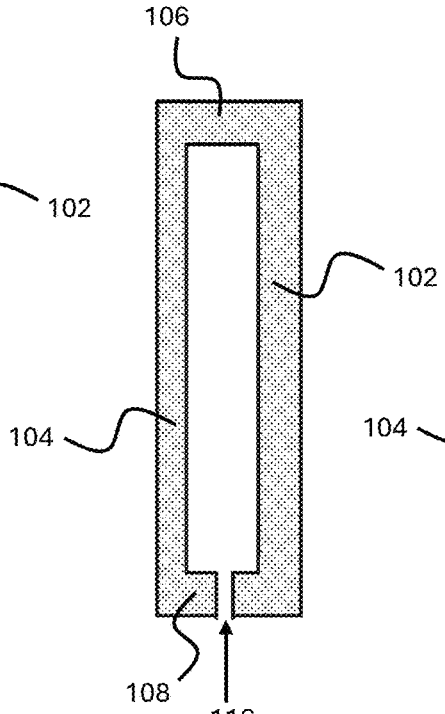
Figure 40:
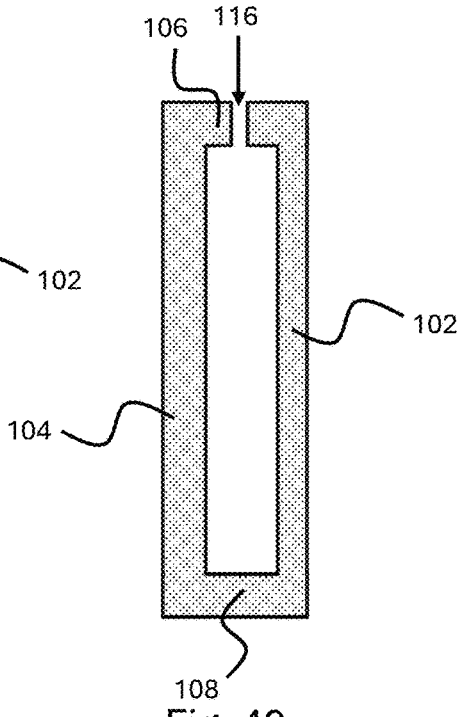

In the example of FIG. 39, the gap 116 splits the lower wall 108. In the example of FIG. 40, the gap 116 splits the upper wall 106.

FIGS. 32-35*b* are side cross-sectional views of the insert of FIGS. 30-31 showing how a part of the hat is introduced into the channel, according to some embodiments of the present invention.

Figure 32:
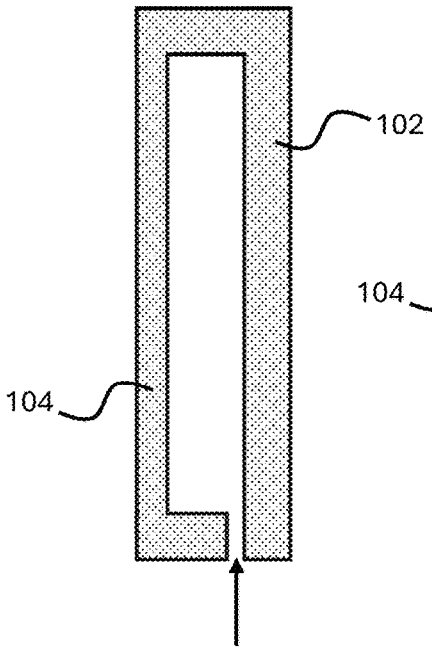
FIGS. 32-35*b* are side cross-sectional views of the insert of FIGS. 30-31 showing how a part of the hat is introduced into the channel, according to some embodiments of the present invention.
Figure 33A:
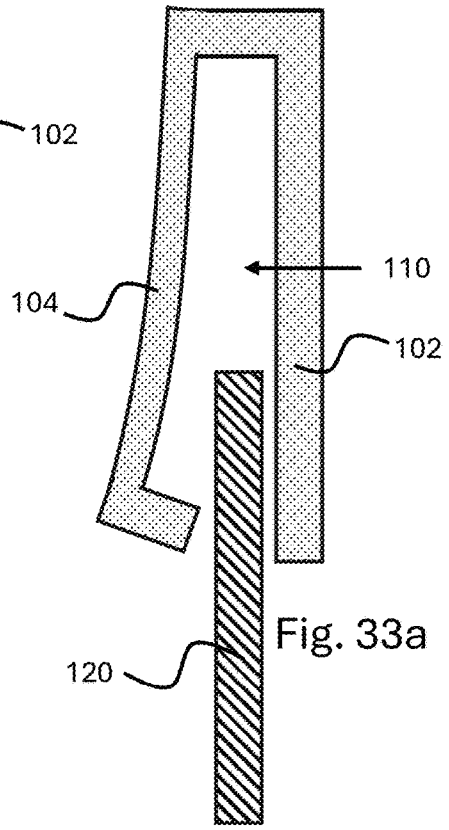
Figure 33B:
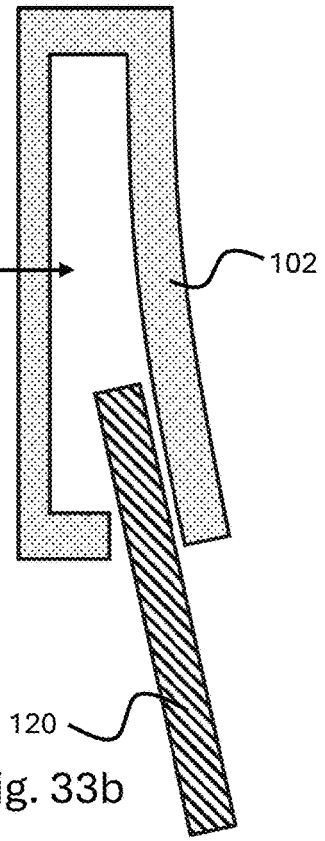

In the example of FIGS. 32-35*b*, the gap 116 separates the front wall 102 from the lower wall 108. In FIG. 32, the insert is in its equilibrium configuration. In FIG. 33*a*, the rear wall 104 and the lower wall 108 are pulled away from the front wall 102, enlarging the gap. Optionally or alternatively, in FIG. 33*b*, the front wall 102 is pulled away from the lower wall 108, enlarging the gap. A hat's part 120 is inserted into the channel 110 via the enlarged gap.

Figure 34:
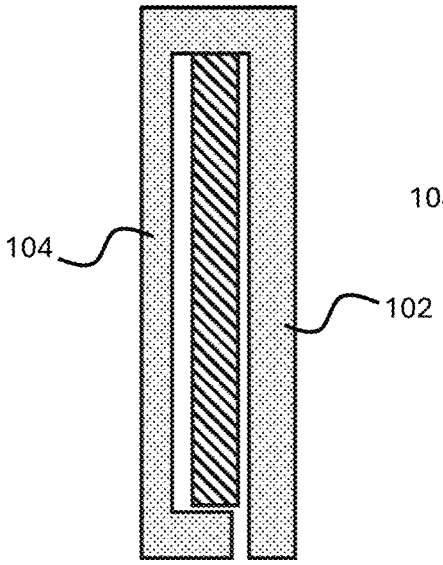
Figure 35A:
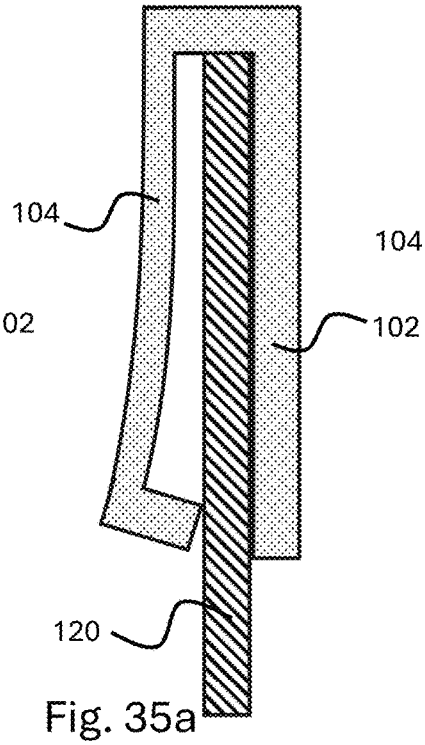
Figure 35B:
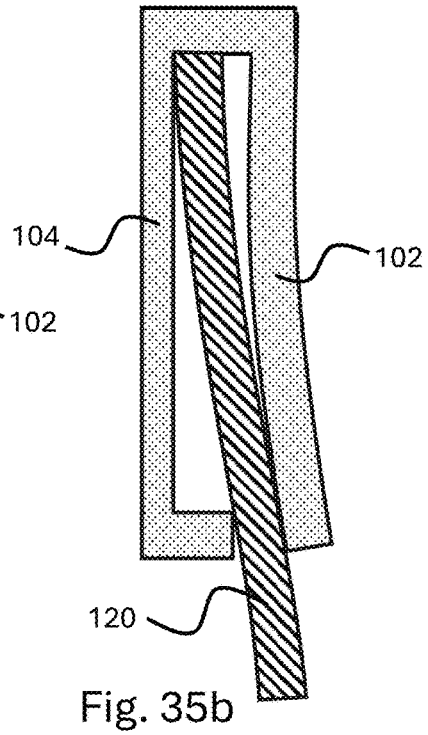

If the hat's part 120 fits into the channel 110, the rear wall and bottom wall and/or the front wall are released and the insert returns to its equilibrium position, as seen in FIG. 34. In this manner, the hat's part 120 is surrounded by all four walls and cannot leave the insert unless the gap is enlarged again.

If the hat's part 120 is longer than the vertical dimension of the channel 110, the hat's part 120 is partially inserted into the channel 110 and the rear wall and bottom wall (FIG. 35*a*) and/or the front wall (FIG. 35*b*) are released. The hat's part is pressed between the lower wall 108 and the front wall 102, making it hard to remove the insert from the hat without enlarging the gap again.

Figure 47:
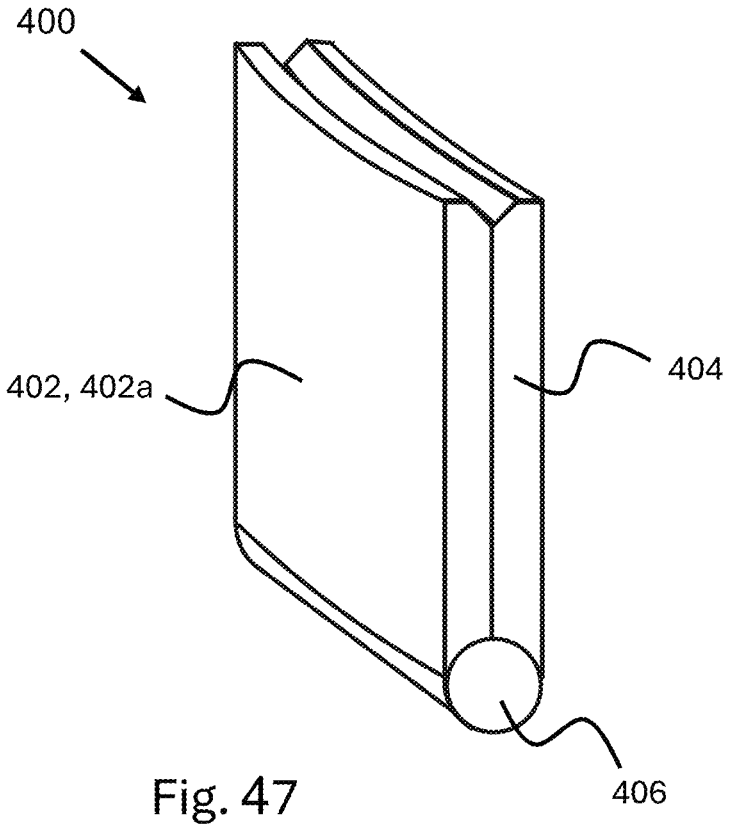
FIGS. 47-48 illustrate a V-shaped insert, according to some embodiments of the present invention.
Figure 48:
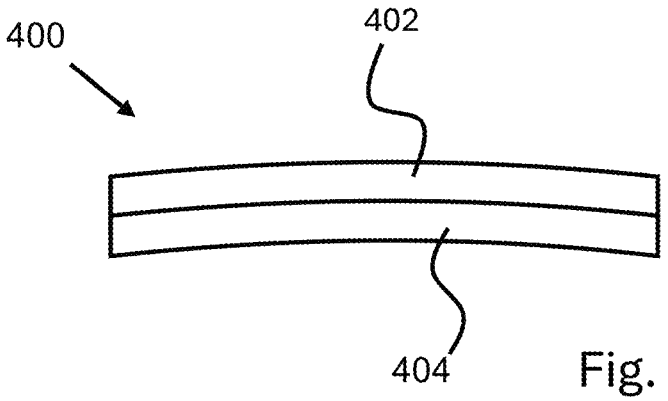

FIGS. 47-48 illustrate a V-shaped insert 400, according to some embodiments of the present invention. FIG. 47 is a three-dimensional view of the insert 400. FIG. 48 is a top view of the insert 400.

In some embodiments of the present invention, the inset 400 is V-shaped. The insert 400 includes a front wall 402, a rear wall 404, and a hinge mechanism 406 hingedly joining the front wall 402 and the rear wall 404. The from wall 402 and the rear wall 404 are similar to the front wall and rear wall of the insert 100 of FIGS. 1-5. The front wall 402 has a front surface 402*a* for displaying an image, as explained above with regard to the front wall 102 of FIGS. 1-5. The rear wall 404 may also display writing or an image, as explained above. The materials of the front wall 402 and rear wall 404 may be the same as those of the insert 100 of FIGS. 1-5.

The front wall 402 and the rear wall 404 may have curved profiles to conform to the curvature of the hat. The front surface of the front wall may have a convex shaped, while the rear surface of the rear wall may have a concave shape.

The hinge mechanism 406 may be spring loaded and biased such that that a rear surface of the front wall 402 and a front surface of the rear wall 404 contact each or are pushed toward each in a closed configuration of the insert 400 (when force is applied to pry the front wall 402 and rear wall 404 apart).

FIGS. 49-52 are side cross-sectional views of the insert of FIGS. 47-48 showing how a part of the hat is introduced between the walls of the insert 400, according to some embodiments of the present invention.

Figure 49:
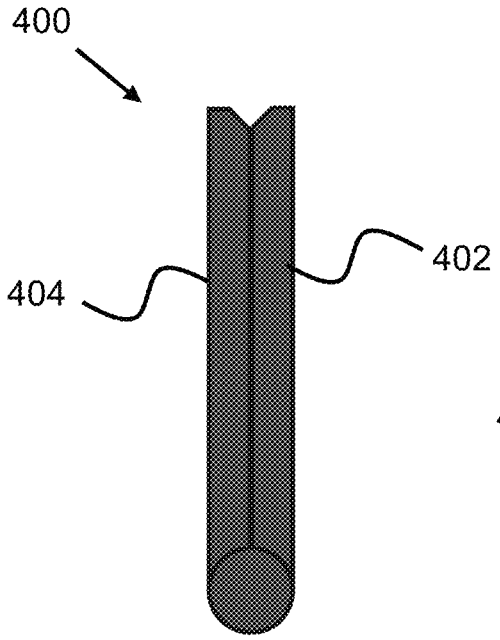
FIGS. 49-52 are side cross-sectional views of the insert of FIGS. 47-48 showing how a part of the hat is introduced between the walls, according to some embodiments of the present invention.
Figure 50:
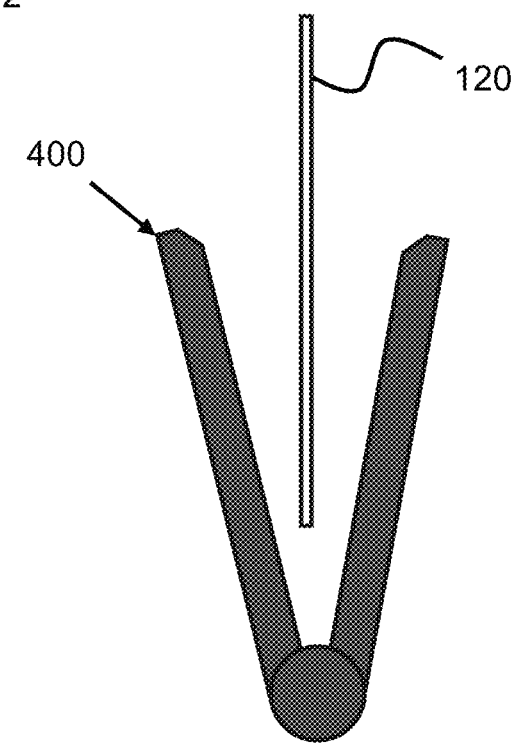
Figure 51:
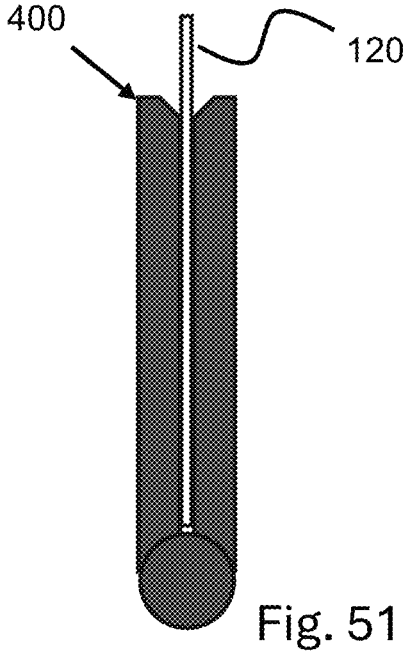
Figure 52:
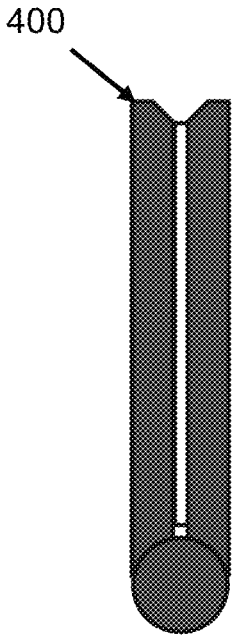

In FIG. 49, the insert 400 is in its closed configuration with the front wall 402 and rear wall 404 contacting each other. In FIG. 50, the front wall 402 and rear wall 404 are pulled apart from each other, rotating in opposite directions about the hinge mechanism, so that a space is created between the front wall 402 and rear wall 404. A hats's part is introduced in the space between the front wall 402 and rear wall 404.

In some embodiments of the present invention, the hat's portion is longer than the vertical dimension of the front wall 402 and rear wall 404. The front wall 402 and rear wall 404 are released and snap back to each other, to press a portion of the hat's part 120 between the front wall 402 and rear wall 404. In this manner, the insert 400 is removably joined to a hat.

In some embodiments of the present invention, the hat's portion is shorter than or has the same size as than the vertical dimension of the front wall 402 and rear wall 404. The front wall 402 and rear wall 404 are released and snap back to each other, to press the hat's part 120 between the front wall 402 and rear wall 404. In this manner, the insert 400 is removably joined to a hat.

What is claimed is:

1. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein the gap separates: the front wall from top wall; or the front wall from the bottom wall; or the rear wall from the top wall; or the rear wall from the bottom wall;

wherein:

the gap separates the rear wall from the top wall and the top wall comprises a jutting extending downward from a bottom surface of the top wall, such that the rear wall is configured to be pushed toward the front wall and snap frontwards past the jutting and the jutting is configured to stop the rear wall from returning to an equilibrium position thereof; or the gap separates the rear wall from the bottom wall and the bottom wall comprises a jutting extending upward from a top surface of the bottom wall, such that the rear wall is configured to be pushed toward the front wall and snap frontwards past the jutting and the jutting is configured to stop the rear wall from returning to the equilibrium position thereof.

2. The insert of claim 1, wherein the insert is semi-rigid and elastic, such that the gap can be enlarged by pulling portions of the insert separated by the gap away from each other, wherein the portions of the insert separated by the gap return to an equilibrium distance from each other when no force is applied thereto.

3. The insert of claim 1, wherein at least one of the walls separated by the gap from one of the adjacent walls has a section closest to the gap having rounded corners.

4. The insert of claim 1, wherein the front wall is configured to have an image printed, etched, or heat stamped on an outer surface thereof.

5. The insert of claim 1, wherein the rear wall is configured to have an image printed, etched, or heat stamped on an outer surface thereof.

6. The insert of claim 1, wherein at least one of the front wall and the rear wall has respective lateral edges that are curved.

7. The insert of claim 1, wherein the insert is made of an injection-molded plastic.

8. The insert of claim 1, wherein the insert comprises Acrylonitrile Butadiene Styrene.

9. The insert of claim 1, wherein the insert comprises metal.

10. The insert of claim 1, wherein a top profile of the insert is curved.

11. The insert of claim 1, wherein the portion of the hat includes a rear strap of a baseball cap.

12. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein:

the gap separates the rear wall from upper wall;

the upper wall has a nook on a bottom surface thereof;

the rear wall has a protrusion extending from a front surface of the rear wall, the protrusion being shaped to snap to the nook.

13. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein:

the gap separates the rear wall from lower wall;

the lower wall has a nook on a top surface thereof;

the rear wall has a protrusion extending from a front surface of the rear wall, the protrusion being shape to snap to the nook.

14. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein the gap separates: the front wall from top wall; or the front wall from the bottom wall; or the rear wall from the top wall; or the rear wall from the bottom wall;

wherein:

if the gap separates the front wall from upper wall, the front wall is shorter than the rear wall;

if the gap separates the front wall from the lower wall, the front wall is shorter than the rear wall;

if the gap separates the rear wall from the upper wall, the rear wall is shorter than the front wall;

if the gap separates the rear wall from the lower wall, the rear wall is shorter than the front wall.

15. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein the gap separates: the front wall from top wall; or the front wall from the bottom wall; or the rear wall from the top wall; or the rear wall from the bottom wall;

wherein:

if the gap separates the front wall from upper wall, the upper wall is shorter than the lower wall;

if the gap separates the front wall from the lower wall, the lower wall is shorter than the upper wall;

if the gap separates the rear wall from the upper wall, the upper wall is shorter than the lower wall;

if the gap separates the rear wall from the lower wall, the lower wall is shorter than the upper wall.

16. An insert for decorating a hat, the insert comprising:

a front wall having a front surface configured to be used as a display space;

a rear wall opposite the front wall;

an upper wall, adjacent to the front wall and to the rear wall;

a lower wall adjacent to the front wall and to the rear wall, and opposite to the upper wall;

wherein the front wall, the rear wall, the upper wall, and the lower wall surround a channel traversing the insert from lateral side to lateral side;

wherein the insert comprises a gap located between any two of the walls that are adjacent to each other, or splitting any one of the walls, for insertion of a part of a hat through the gap for retention of the part of the hat within the channel to cause the insert to be removably joined to the hat;

wherein the bottom wall or the upper wall is split by the gap.

* * * * *